US011078790B2

(12) United States Patent
Holdsworth et al.

(10) Patent No.: US 11,078,790 B2
(45) Date of Patent: Aug. 3, 2021

(54) ELECTRIC DRILLING AND BOLTING DEVICE

(71) Applicant: Joy Global Underground Mining LLC, Warrendale, PA (US)

(72) Inventors: Robert Holdsworth, Cordeaux Heights (AU); Brad Neilson, Mount Keira (AU); Peter Hanna, Oatley (AU)

(73) Assignee: Joy Global Underground Mining LLC, Warrendale, PA (US)

( * ) Notice: Subject to any disclaimer, the term of this patent is extended or adjusted under 35 U.S.C. 154(b) by 460 days.

(21) Appl. No.: 15/642,839

(22) Filed: Jul. 6, 2017

(65) Prior Publication Data

US 2018/0010454 A1 Jan. 11, 2018

Related U.S. Application Data

(60) Provisional application No. 62/358,757, filed on Jul. 6, 2016.

(51) Int. Cl.

| | |
|---|---|
| ***E21D 20/00*** | (2006.01) |
| ***E21B 19/08*** | (2006.01) |
| ***E21B 7/02*** | (2006.01) |

(52) U.S. Cl.

CPC ..... *E21D 20/003* (2013.01); *E21B 7/027* (2013.01); *E21B 19/08* (2013.01)

(58) Field of Classification Search

CPC ..... F16H 13/12
USPC ..... 173/90, 184; 74/89.23
See application file for complete search history.

(56) References Cited

U.S. PATENT DOCUMENTS

| | | | | |
|---|---|---|---|---|
| 3,078,932 A | | 2/1963 | Nixon | |
| 4,390,309 A | * | 6/1983 | Fangmann | B25H 1/0071 248/667 |
| 4,832,536 A | | 5/1989 | Spross et al. | |
| 4,844,661 A | * | 7/1989 | Martin | E02D 7/06 405/232 |
| 5,026,218 A | | 6/1991 | Zimmerman | |

(Continued)

FOREIGN PATENT DOCUMENTS

| | | | |
|---|---|---|---|
| CN | 104777520 A | | 7/2015 |
| JP | 2000320466 A | * | 11/2000 |

OTHER PUBLICATIONS

Translation of JP2000320466 (Year: 1999).*

(Continued)

*Primary Examiner* — Robert F Long
(74) *Attorney, Agent, or Firm* — Michael Best & Friedrich LLP

(57) ABSTRACT

A drilling and bolting device for driving a drill element into a rock surface includes a frame, a drive unit supported for movement relative to the frame, and an actuator for moving the drive unit relative to the frame. The drive unit includes a motor and a chuck for engaging the drill element. The chuck is driven by the motor. In some aspects, the actuator includes a magnet exerting a magnetic force on the block to provide magnetic coupling between the actuator and a block supporting the motor. In some aspects, the actuator is positioned at least partially within an elongated member of the frame. In some aspects, the drive unit includes a switched reluctance motor including a stator and a rotor supported for rotation relative to the stator, and the rotor is directly coupled to the chuck.

18 Claims, 29 Drawing Sheets

(56) References Cited

U.S. PATENT DOCUMENTS 5,390,747 A * 2/1995 Gu ..... E21B 7/02 173/11
5,462,392 A * 10/1995 Hardwick ..... B23B 47/287 408/110
5,523,635 A * 6/1996 Ferreira ..... F02N 11/04 310/54
5,575,344 A 11/1996 Wireman
5,751,083 A * 5/1998 Tamura ..... H02K 49/102 310/80
6,084,326 A * 7/2000 Nagai ..... F16H 25/2418 310/103
6,105,684 A 8/2000 Pointer et al.
6,135,674 A 10/2000 Neilson
6,302,623 B1 10/2001 Nellson
6,413,019 B1 7/2002 Coombs et al.
6,497,536 B1 12/2002 Neilson et al.
6,598,309 B1 7/2003 Coombs
6,662,672 B2 * 12/2003 Someya ..... F16H 25/20 74/89.22
6,796,388 B2 9/2004 O'Meley
6,814,155 B1 11/2004 Nielson et al.
7,607,866 B2 10/2009 Eddowes et al.
7,905,692 B2 * 3/2011 Hamura ..... B23Q 1/34 310/12.01
9,664,041 B2 * 5/2017 Jones ..... E21B 11/00
2006/0269369 A1 * 11/2006 Fritsche ..... B23B 47/34 408/17
2008/0289440 A1 * 11/2008 Denk ..... F16C 31/00 74/89.34
2009/0229846 A1 * 9/2009 Kawano ..... B25B 23/0085 173/217
2009/0242224 A1 * 10/2009 Hamura ..... H02K 41/03 173/152
2009/0275273 A1 * 11/2009 Purohit ..... H02K 7/145 451/357
2010/0236802 A1 * 9/2010 Berger ..... B25D 11/064 173/118
2010/0266346 A1 * 10/2010 Eddowes ..... B65H 51/10 405/259.1
2010/0294479 A1 * 11/2010 Shee ..... E21B 33/076 166/65.1
2011/0108600 A1 * 5/2011 Pedicini ..... B25C 1/047 227/2
2012/0223121 A1 * 9/2012 Viola ..... A61B 17/072 227/175.1
2013/0133909 A1 * 5/2013 Greenwood ..... E21B 4/10 173/90
2014/0054350 A1 * 2/2014 Pedicini ..... B25C 5/15 227/8
2014/0364913 A1 * 12/2014 Culbert ..... A61B 17/7016 606/258
2014/0374461 A1 * 12/2014 Pedicini ..... B25C 1/06 227/2
2015/0167463 A1 6/2015 Jones et al.
2015/0290689 A1 * 10/2015 Bolik ..... B21B 1/16 72/249
2017/0044848 A1 * 2/2017 Coyle, Jr. ..... E21B 19/08
2017/0113337 A1 * 4/2017 Dostinov ..... F15B 11/08
2019/0178082 A1 * 6/2019 Hanna ..... E21D 20/003
2020/0073005 A1 * 3/2020 Tang ..... G01V 3/08

OTHER PUBLICATIONS

International Search Report and Written Opinion for Application No. PCT/US2017/040889 dated Sep. 6, 2017 (12 pages).
Search Report issued by the Polish Patent Office for Application No. P-429749 dated Apr. 27, 2020 (7 pages including English translation).
Office Action issued by the Chinese Patent Office for Application No. 201780046562.1 dated Jun. 8, 2020 (6 pages ncluding statement of relevance).
Chinese Patent Office Second Office Action for Application No. 201780046562.1 dated Feb. 24, 2021 (4 pages including English summary).

* cited by examiner

ELECTRIC DRILLING AND BOLTING DEVICE

CROSS-REFERENCE TO RELATED APPLICATION

This application claims the benefit of prior-filed, U.S. Provisional Patent Application No. 62/358,757, filed Jul. 6, 2016, the entire contents of which are hereby incorporated by reference.

BACKGROUND

The present disclosure relates to drill devices, and particularly to a drilling and bolting device for forming a hole or inserting a bolt into a hole in a rock surface.

Conventional drilling and bolting rigs may include an extendable support frame and a drive unit movable along the frame. The drive unit drives a drill bit or bolt into a rock surface. The actuation of the drilling and bolting rig is typically achieved using fluid power (e.g., hydraulic power).

SUMMARY

In one aspect, a drilling and bolting machine includes a frame, a drive unit supported for movement relative to the frame, and an actuator for moving the drive unit relative to the frame. The drive unit includes a block, a motor supported on the block, and a chuck for engaging a drill element. The chuck is driven by the motor. The actuator includes a magnet exerting a magnetic force on the block to provide magnetic coupling between the actuator and the block.

In another aspect, a drilling and bolting device includes a frame, a drive unit, and an actuator for moving the drive unit relative to the frame. The frame includes at least one elongated member extending parallel to a feed axis. The drive unit is supported for movement relative to the frame along the feed axis. The drive unit includes a block, a motor supported on the block, and a chuck for engaging a drill element. The chuck is driven by the motor. The actuator is positioned at least partially within the at least one elongated member.

In yet another aspect, a drilling and bolting device for driving a drill element into a rock surface includes a frame and a drive unit supported for movement relative to the frame along a feed axis. The drive unit includes a switched reluctance motor and a chuck for driving the drill element. The switched reluctance motor includes a stator and a rotor supported for rotation relative to the stator, and the rotor is directly coupled to the chuck.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, aspects of the invention may be implemented in software (for example, stored on non-transitory computer-readable medium) executable by one or more processing units, such as a microprocessor, an application specific integrated circuits ("ASICs"), or another electronic device. As such, it should be noted that a plurality of hardware and software based devices, as well as a plurality of different structural components may be utilized to implement the invention. For example, "controllers" described in the specification may include one or more electronic processors or processing units, one or more computer-readable medium modules, one or more input/output interfaces, and various connections (for example, a system bus) connecting the components.

Figure 1A:
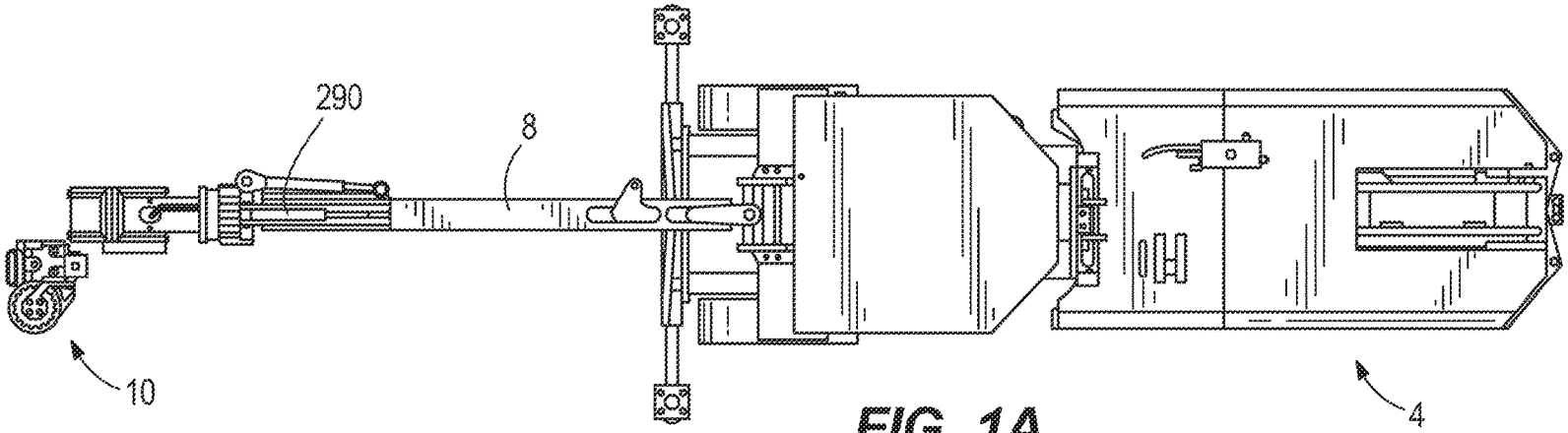
FIG. 1A is a plan view of a mobile machine.
Figure 1B:
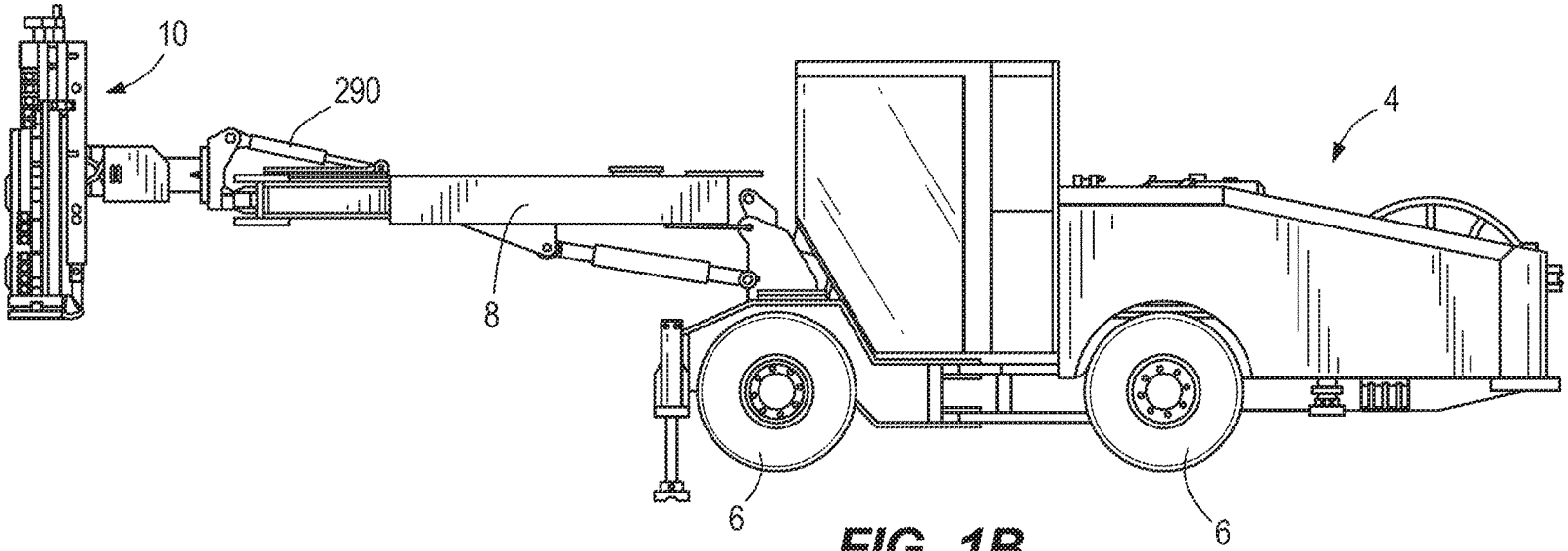
FIG. 1B is a side view of the mobile machine of FIG. 1A.

FIGS. 1A and 1B illustrate a mobile mining machine, such as a bolting jumbo or bolting machine 4. In the illustrated embodiment, the machine 4 includes a traction mechanism 6 (e.g., wheels—FIG. 1B) and a boom 8. The boom 8 supports a drilling and bolting rig, or drill device 10, for forming holes in a mine surface (e.g., a roof, a floor, or a rib or side wall—not shown) and/or installing a drill element (e.g., a bit or a bolt 14—FIG. 2A). In the illustrated embodiment, the drill device 10 performs both drilling and bolting operations. Among other things, an installed bolt 14 may anchor or support a safety mesh (not shown) to protect personnel against rock that may fall or become dislodged from the mine surface. In some embodiments, the drill device 10 may be mounted on another type of mining machine, such as a continuous mining machine (not shown).

Figure 2A:
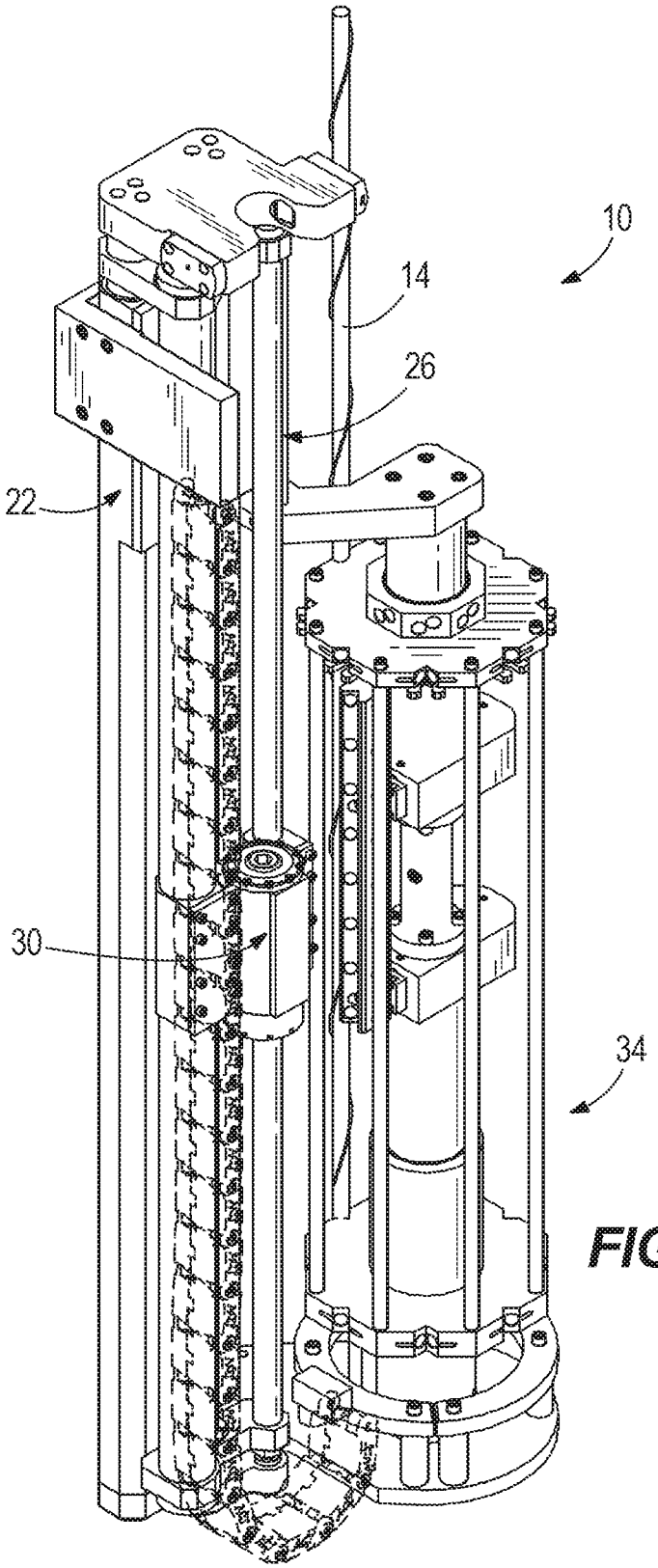
FIG. 2A is a perspective view of a drilling and bolting device including a carousel.
Figure 2B:
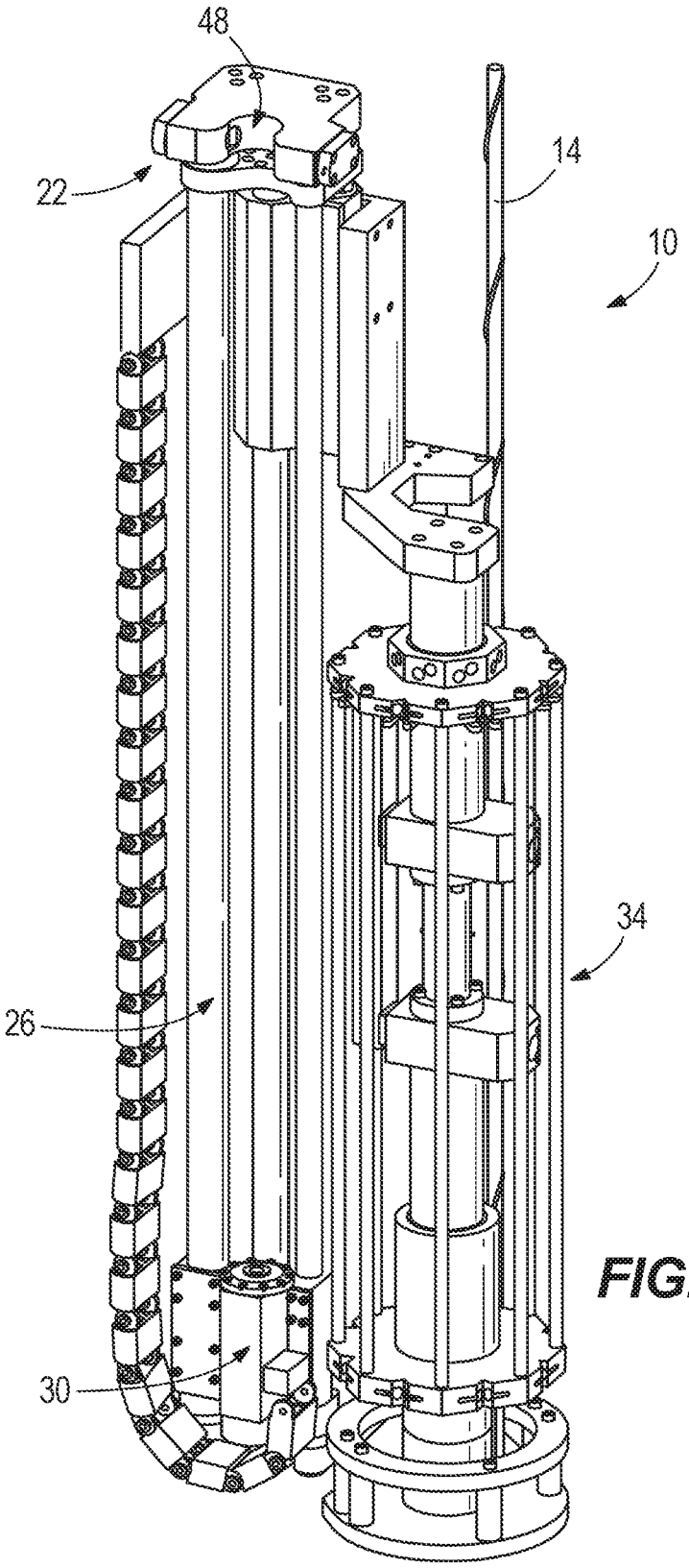
FIG. 2B is another perspective view of the drilling and bolting device and the carousel of FIG. 2A.

As shown in FIGS. 2A and 2B, the drill device 10 includes a first stage or jack or base 22, a second stage or feed frame 26, and a drive unit or rotation unit 30. In the illustrated embodiment, the drill device 10 also includes a storage magazine or carousel 34 for storing additional drill bits or bolts 14 until the bits or bolts 14 are needed. The carousel 34 can automate the transfer of the bits and bolts 14 to the rotation unit 30. In other embodiments (not shown), a user can manually feed the bits and bolts 14 to the rotation unit 30.

Figure 3:
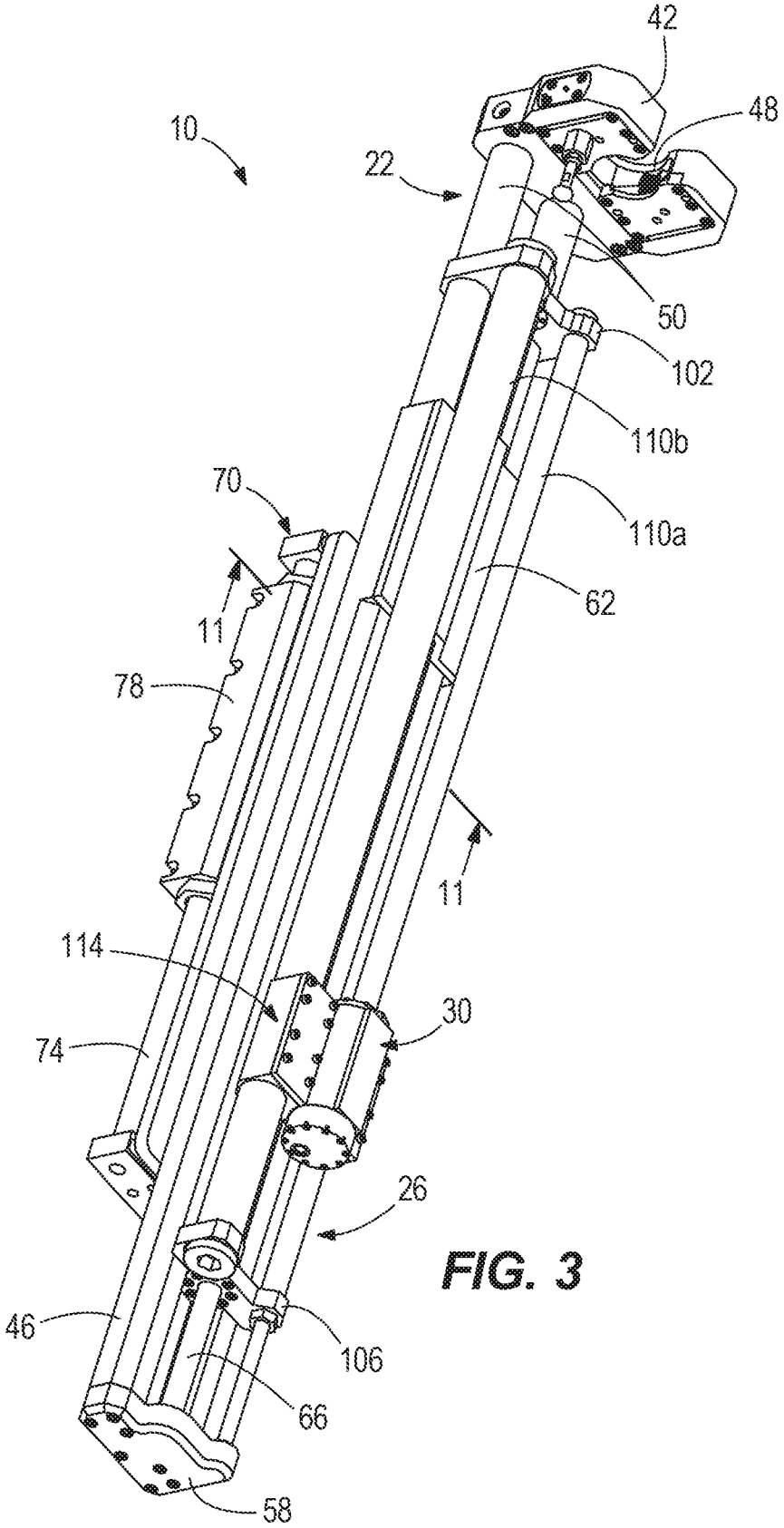
FIG. 3 is a perspective view of the drilling and bolting device of FIG. 2A without the carousel attached.

As shown in FIG. 3, the base 22 includes a first end or upper block 42, a lower block 46 positioned proximate a second end, and a pair of elongated base rods or base bars 50 oriented parallel to one another and extending between the upper block 42 and the lower block 46. In other embodiments, the base 22 may include fewer or more bars. The upper block 42 may include a clamp or gripping device 48 for aligning and/or gripping the rod or bolt 14 during insertion into the rock surface. The upper block 42 is secured to ends of the base bars 50, and the base bars 50 are slidable relative to the lower block 46. Movement of the base bars 50 causes the upper block 42 to move toward or away from the lower block 46, thereby retracting or extending the upper block 42. In the illustrated embodiment, the lower block 46 is formed as a sleeve receiving a portion of the base bars 50 when the upper block 42 is in a retracted position. The lower block 46 includes an end plate 58 and a guide block or stop member 62. The base 22 further includes a guide rod or guide bar 66 having an end coupled to the end plate 58. The guide bar 66 extends between the end plate 58 and the stop member 62. The guide bar 66 is described in further detail below.

Figure 4:
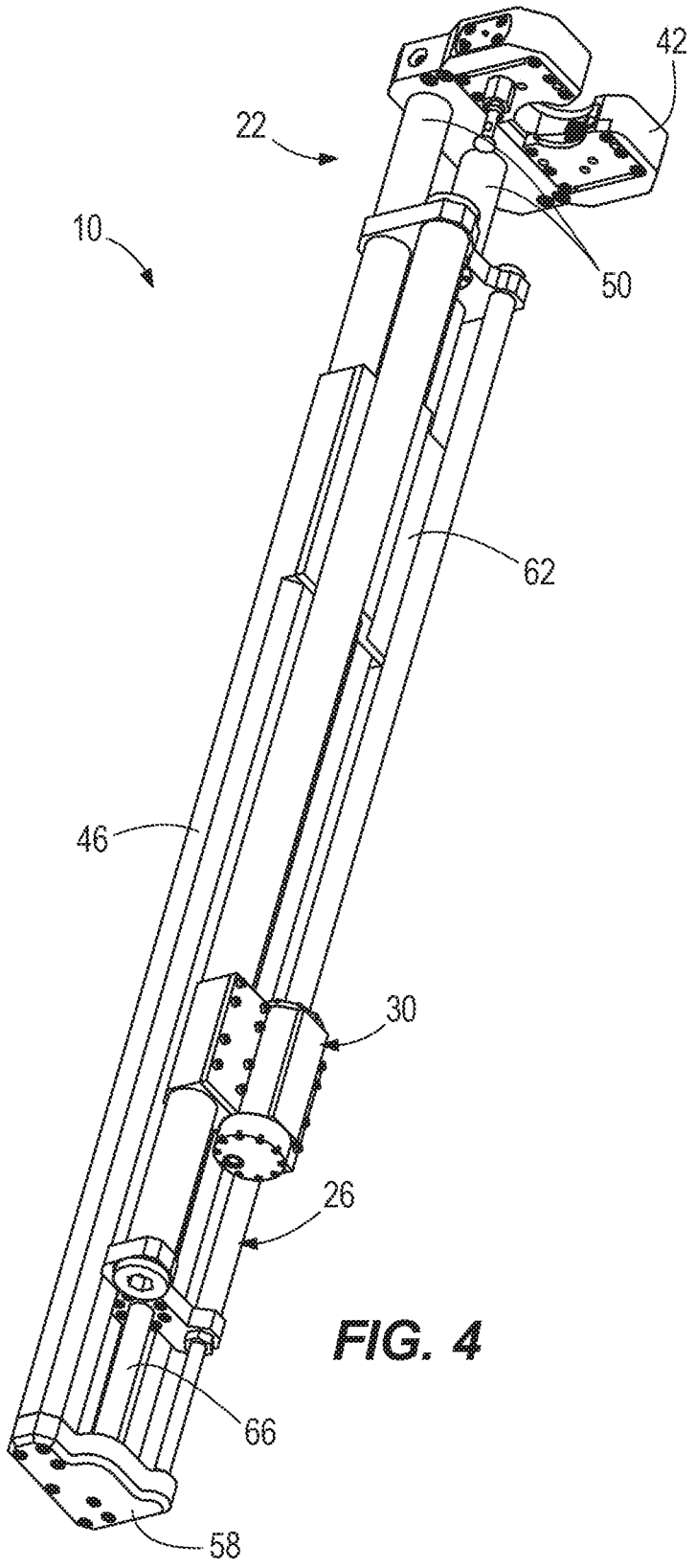
FIG. 4 is a perspective view of a drilling and bolting device according to another embodiment.

In the illustrated embodiment, the base 22 (e.g., the lower block 46) is supported on a mounting block 70 which includes a pair of support bars 74. A support bracket or support portion 78 is coupled to the support bars 74 and is connected to an end of the boom 8 (FIG. 1B) or another arm mounted on the machine 4. The support bars 74 are slidable relative to the support portion 78, permitting sliding movement of the base 22 relative to the support portion 78 and the boom 8. In other embodiments (FIG. 4), the drill device 10 may omit the mounting block and/or may be supported in a different manner.

Figure 5:
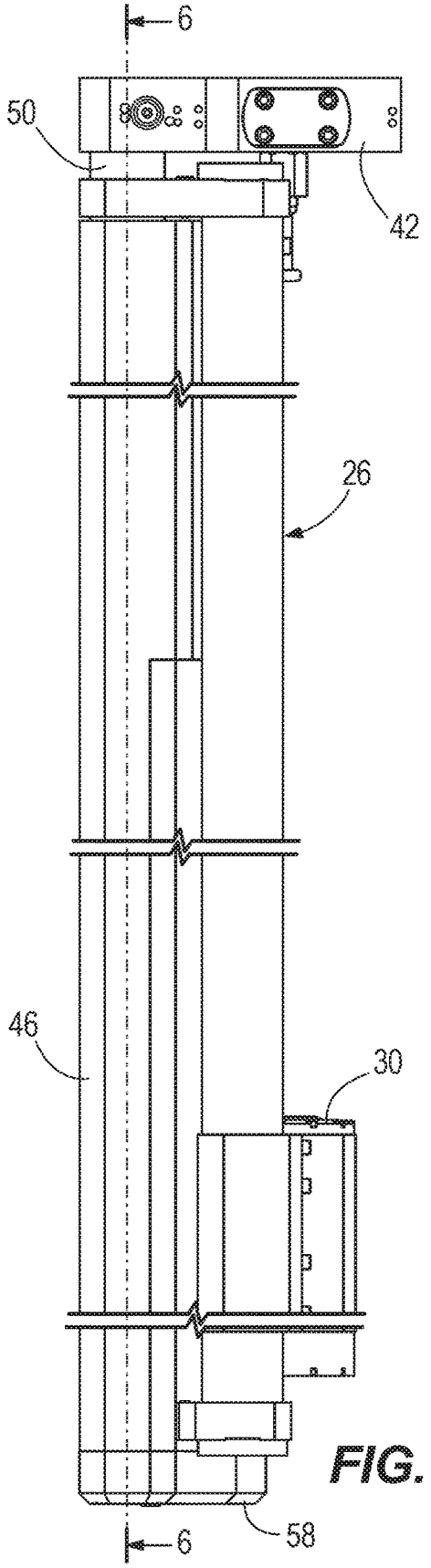
FIG. 5 is a side view of a drilling and bolting device according to yet another embodiment.
Figure 6:
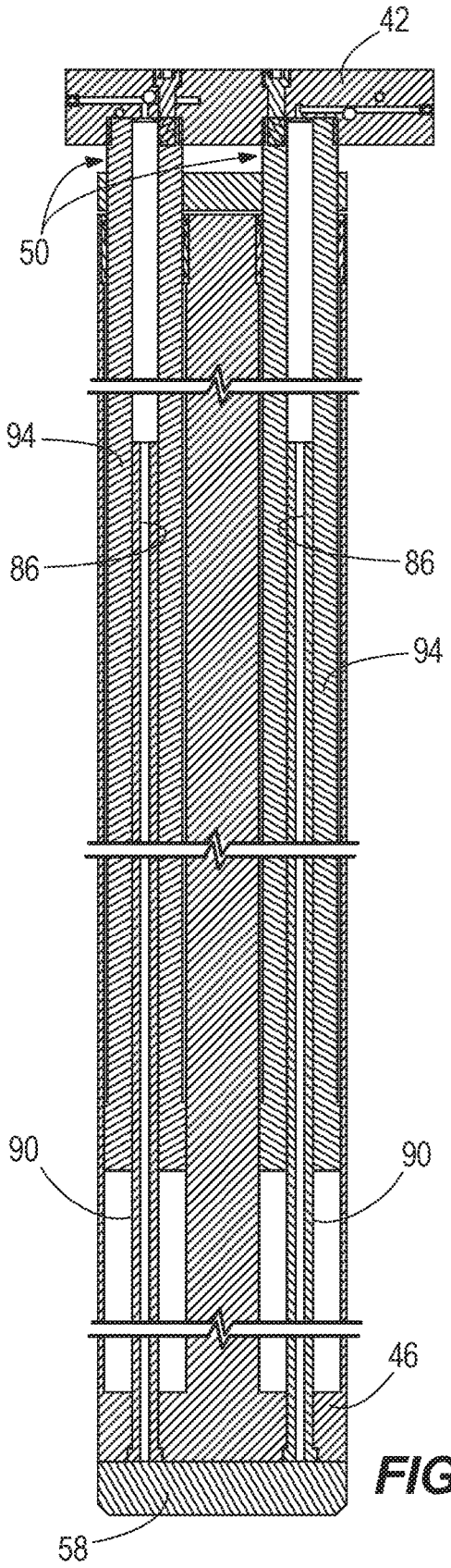
FIG. 6 is a section view of the drilling and bolting device of FIG. 5, viewed along section 6-6.
Figure 7:
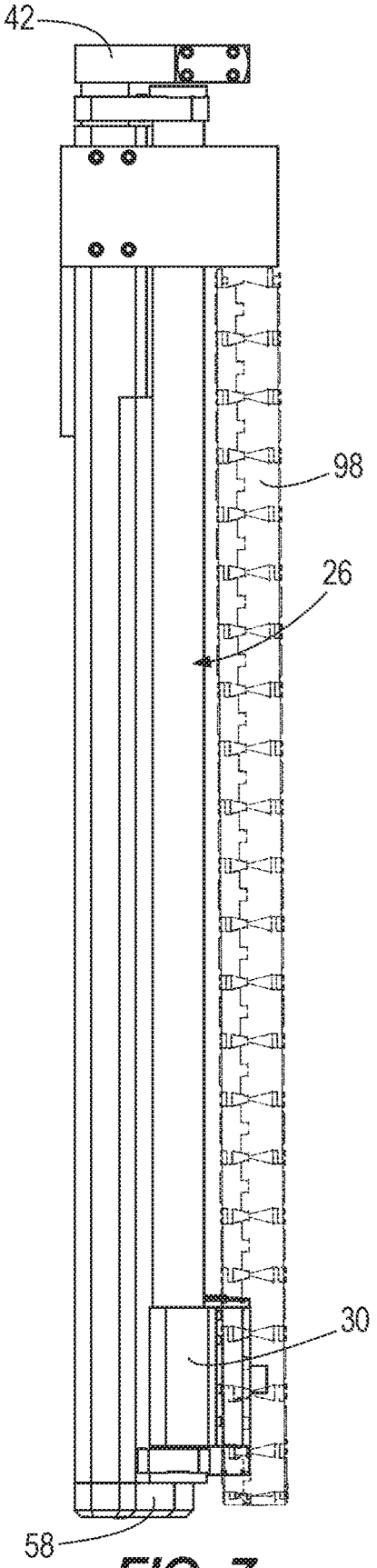
FIG. 7 is a side view of a drilling and bolting device including an energy chain.
Figure 8:
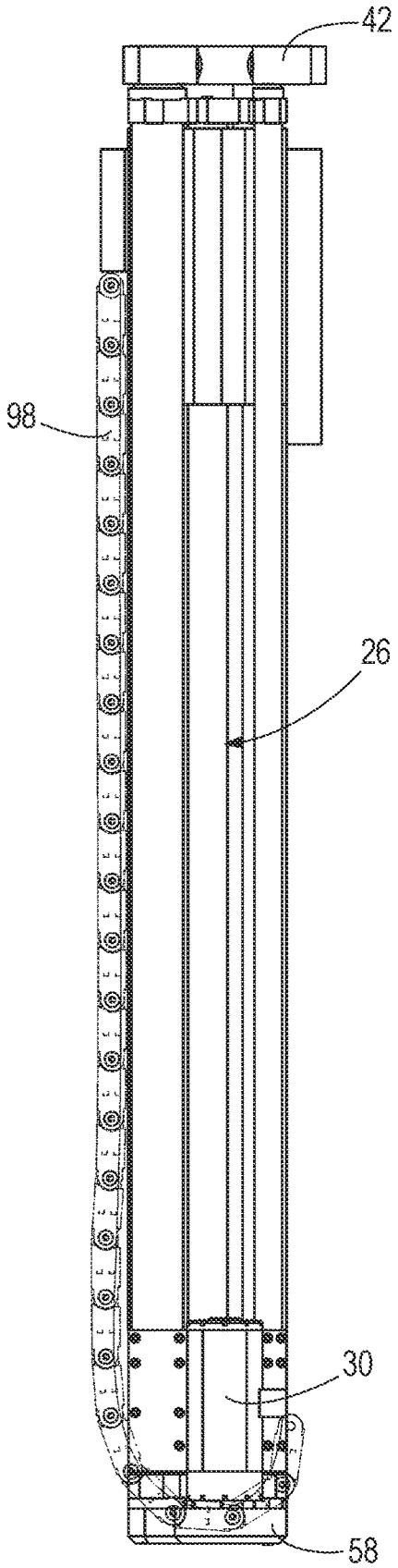
FIG. 8 is a front view of the drilling and bolting device of FIG. 7.

As shown in FIGS. 5 and 6, in some embodiments each of the base bars 50 may include an internal passageway 86 (FIG. 6) for transferring fluid (e.g., pressurized hydraulic fluid) from the lower block 46 to the upper block 42 in order to actuate the gripping device. In the illustrated embodiment of FIG. 6, the fluid is conveyed through the lower block 46 to a first tube 90 and then to a second tube 94 that is telescopically movable relative to the first tube 90 and is connected to the upper block 42. In some embodiments, shown for example in FIGS. 7 and 8, a flexible energy chain 98 houses a section of fluid conduit (e.g., hose) and electric cable (not shown) to protect and guide the conduit and cable as the feed frame 26 moves on the base bars 50 (FIG. 3). Positioning the internal fluid passageway 86 within the base bars 50 permits control valves to be mounted directly on the drill device 10, providing a more compact system with fewer fluid connections than conventional drill devices. In the illustrated embodiment, the drill device 10 operates due to a combination of hydraulic power and electrical power; in some embodiments, the drill device may be entirely driven by electrical power and electrical actuators.

Referring again to FIG. 3, the feed frame 26 includes an upper feed block 102, a lower feed block 106, a pair of feed bars 110, and a slide block 114 movably coupled to the feed bars 110. In the illustrated embodiment, the upper feed block 102 is coupled to the base bars 50 and is slidable along the base bars 50 between the upper block 42 and the lower block 46. The lower feed block 106 is positioned between the end plate 58 and the stop member 62, and is slidable along the lower block 46 between the end plate 58 and the stop member 62. The lower feed block 106 is coupled to the guide bar 66 and slidable along the guide bar 66. The guide bar 66 extends from the end plate 58 to the upper feed block 102, passing through a portion of the lower feed block 106.

The guide bar 66 may be formed as a telescoping cylinder to accommodate the movement of the feed frame 26 relative to the end plate 58.

Figure 9:
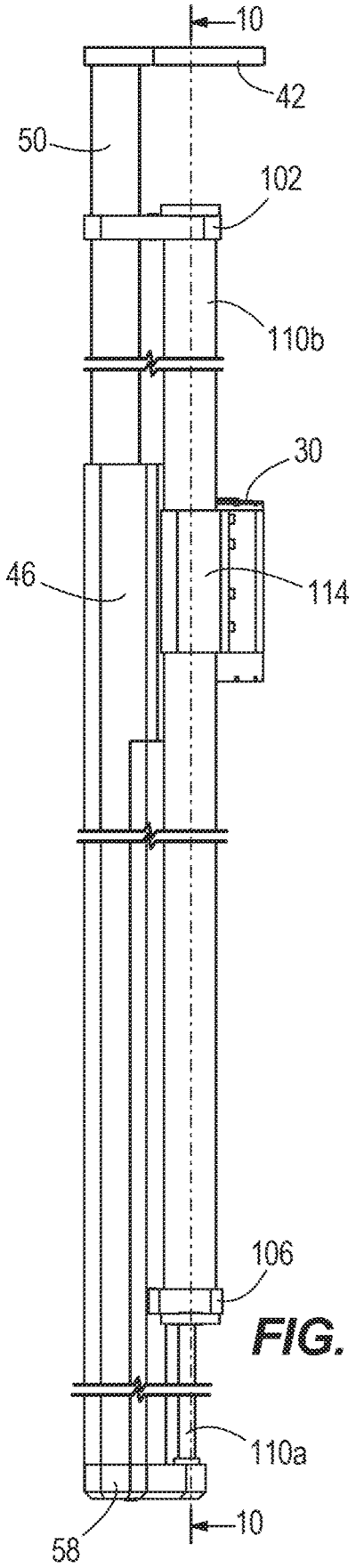
FIG. 9 is a side view of the drilling and bolting device of FIG. 3 with a mounting block removed.

As shown in FIG. 9, the base bars 50 are extendable relative to the lower block 46, and the feed bars 110 are movable along the base bars 50. The slide block 114 moves along the feed bars 110, to provide double telescoping movement in a compact system.

Figure 10:
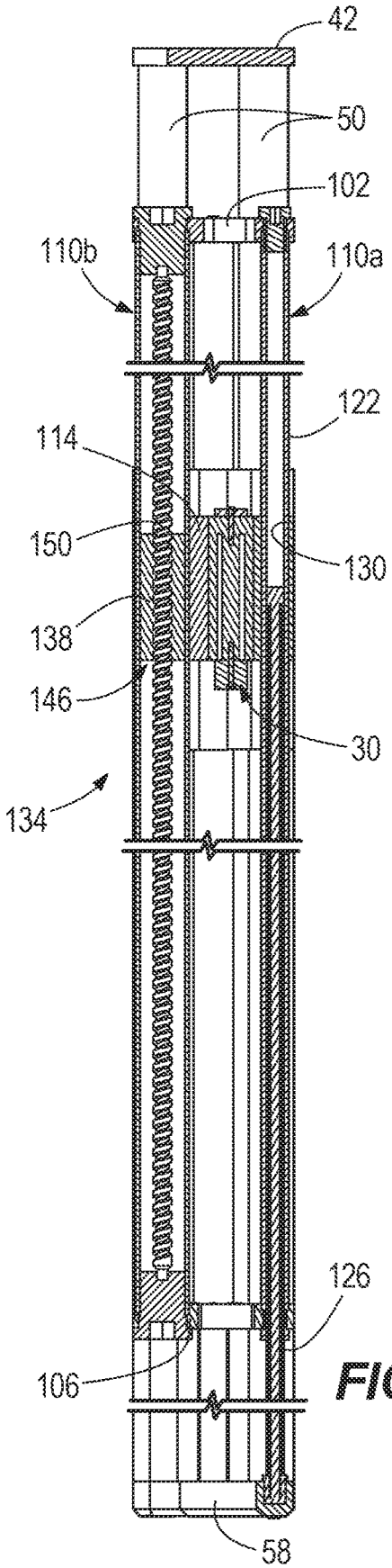
FIG. 10 is a section view of the drilling and bolting device of FIG. 9, viewed along section 10-10.

As shown in FIG. 10, in the illustrated embodiment, each of the feed bars 110 is hollow. A first feed bar 110*a* extends between the end plate 58 of the base 22 and the upper feed block 102, passing through the lower feed block 106. In the illustrated embodiment, the first feed bar 110*a* is formed as a telescoping cylinder including a first portion 122 and a second portion 126. The first portion 122 extends between the lower feed block 106 and the upper feed block 102, while the second portion 126 extends from the end plate 58 and extends into an internal bore 130 of the first portion 122. The second feed bar 110*b* extends between the lower feed block 106 and the upper feed block 102. In some embodiments, the telescoping cylinder of the first feed bar 110*a* provides a passage for transferring power from the base 22 to the feed frame 26 in order to power a drive mechanism 134 as explained in further detail below. In the illustrated embodiment, the power is provided through electrical connections; in other embodiments, the power may be provided through pressurized fluid (e.g., hydraulic fluid). Also, in the illustrated embodiment, the feed bars 110 have different outer dimensions, and the second feed bar 110*b* has a larger diameter than the first feed bar 110*a*. In other embodiments, the feed bars 110 may have the same outer dimension, or the second feed bar 110*b* may have a smaller diameter than the first feed bar 110*a*.

Referring again to FIG. 10, a linear actuator or drive mechanism 134 is positioned inside the second feed bar 110*b*. In the illustrated embodiment, the drive mechanism 134 includes a magnet 138 (e.g., a rare earth magnet 138 or an electromagnet) or a linear electric motor. The magnet 138 can provide a non-contact coupling force on the slide block 114 to maintain the position of the slide block 114 relative to the feed bar 110*b*. Also, the slide block 114 is sufficiently long to provide an exclusion zone to prevent magnetic material from accumulating on the feed bars 110. In the illustrated embodiment, the magnet 138 is positioned in the second feed bar 110*b* alone, and the first feed bar 110*a* primarily acts as a reaction support member to counteract the torque caused by drilling or bolting operations. In other embodiments, a drive mechanism 134 may be positioned in each of the feed bars 110.

The drive mechanism 134 facilitates linear movement of the magnet 138 within the second feed bar 110*b*. In the illustrated embodiment, the linear motivator is a ball screw device 146 including a threaded shaft 150 extending along the length of the second feed bar 110*b*, through the magnet 138. Rotation of the threaded shaft 150 (or alternatively, rotation of the magnet 138) causes the magnet 138 to move along the threaded shaft 150 between the upper feed block 102 and the lower feed block 106, thereby also moving the slide block 114.

It is understood that a similar ball screw device could be incorporated into the base bars 50 in a similar manner such that extension and retraction of the base bars 50 is driven by an electrical actuator as well. Furthermore, in the illustrated embodiment, the guide bar 66 (FIG. 3) is a telescoping cylinder having an outer portion that moves along the stop member 62. The internal portion of the guide bar 66 may include a ball screw device similar to that described above, or may include another type of linear actuator (e.g., a fluid cylinder).

Also, in other embodiments, the second feed bar 110*b* may include a pressurized fluid to move the magnet 138 between the upper feed block 102 and the lower feed block 106. Furthermore, the drill device 10 can be operated by a combination of hydraulic and electrical power. For example, the actuation of the base bars may be hydraulically driven, while the actuation of the feed bars is electrically driven. In other embodiments, the base bars may be driven electrically while the feed bars are driven hydraulically, or both the base bars and feed bars may be driven by the same type of power (e.g., hydraulic or electrical). The use of the ball screw device 146 or another type of electric actuator in both the base bars 50 and the feed bars 110 allows the drill device 10 to be entirely electrically driven and eliminates the weight and complexity associated with conventional hydraulic drive systems.

Figure 11:
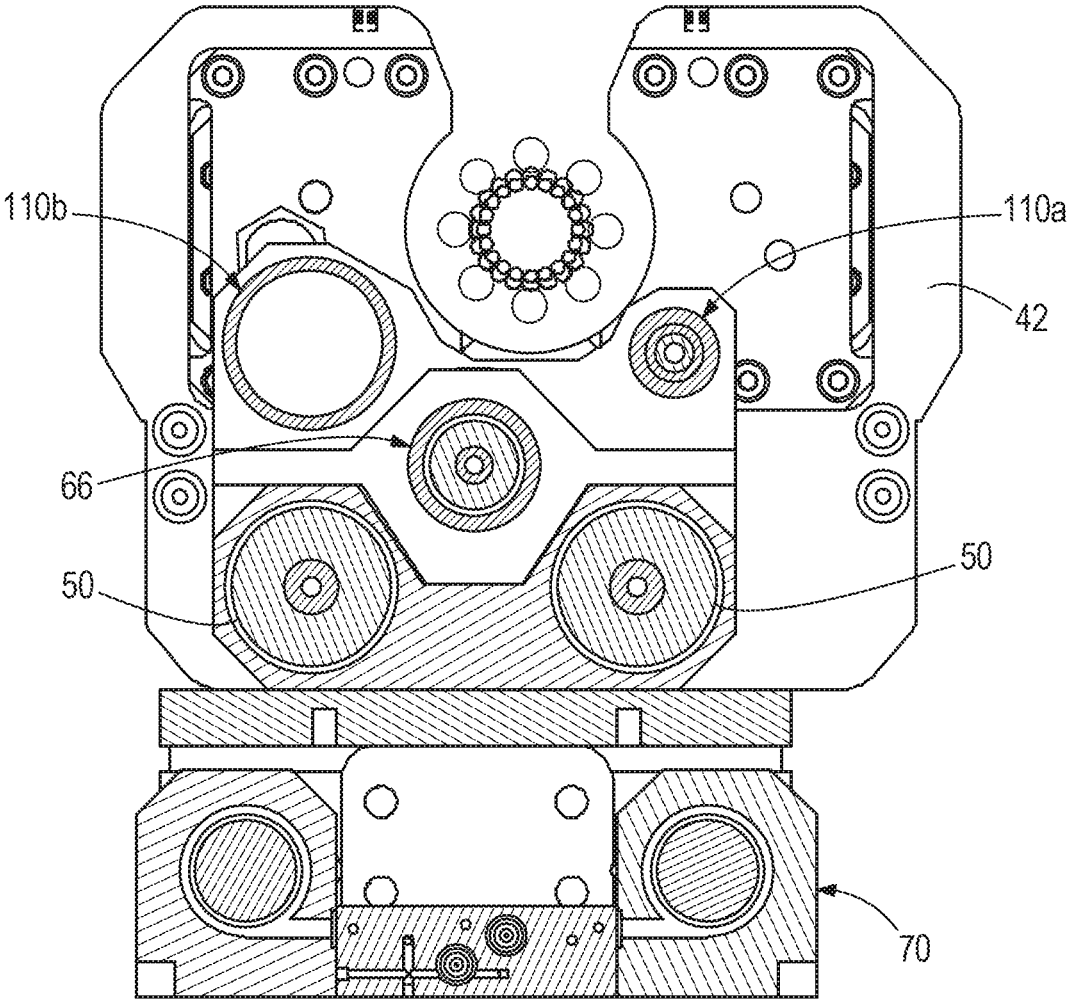
FIG. 11 is a section view of the drilling and bolting device of FIG. 3, viewed along section 11-11.
Figure 12:
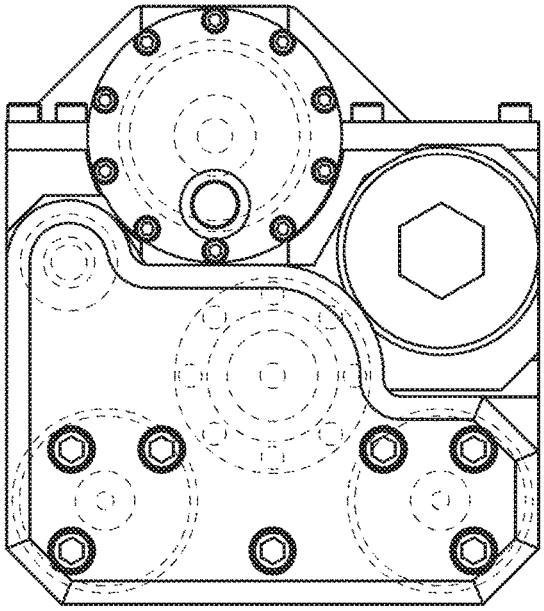
FIG. 12 is a plan view of a drilling and bolting device according to another embodiment.
Figure 13:
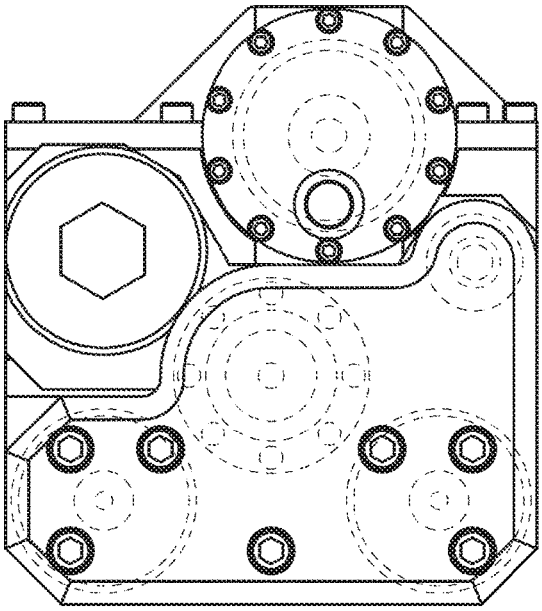
FIG. 13 is a plan view of a drilling and bolting device according to another embodiment.
Figure 14:
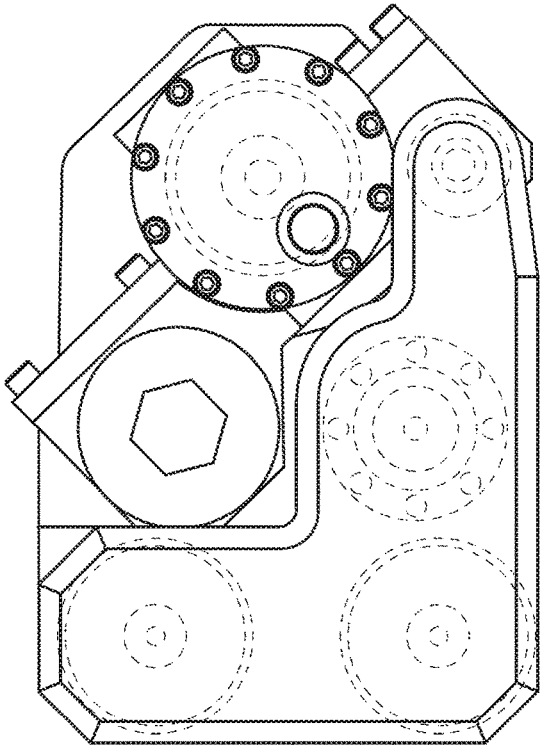
FIG. 14 is a plan view of a drilling and bolting device according to another embodiment.

FIG. 11 illustrates a section view of the drill device 10. As shown in FIGS. 12-14, in other embodiments the relative positions of the base bars 50, guide bar 66, and feed bars 110 can be configured in various ways.

Figure 15:
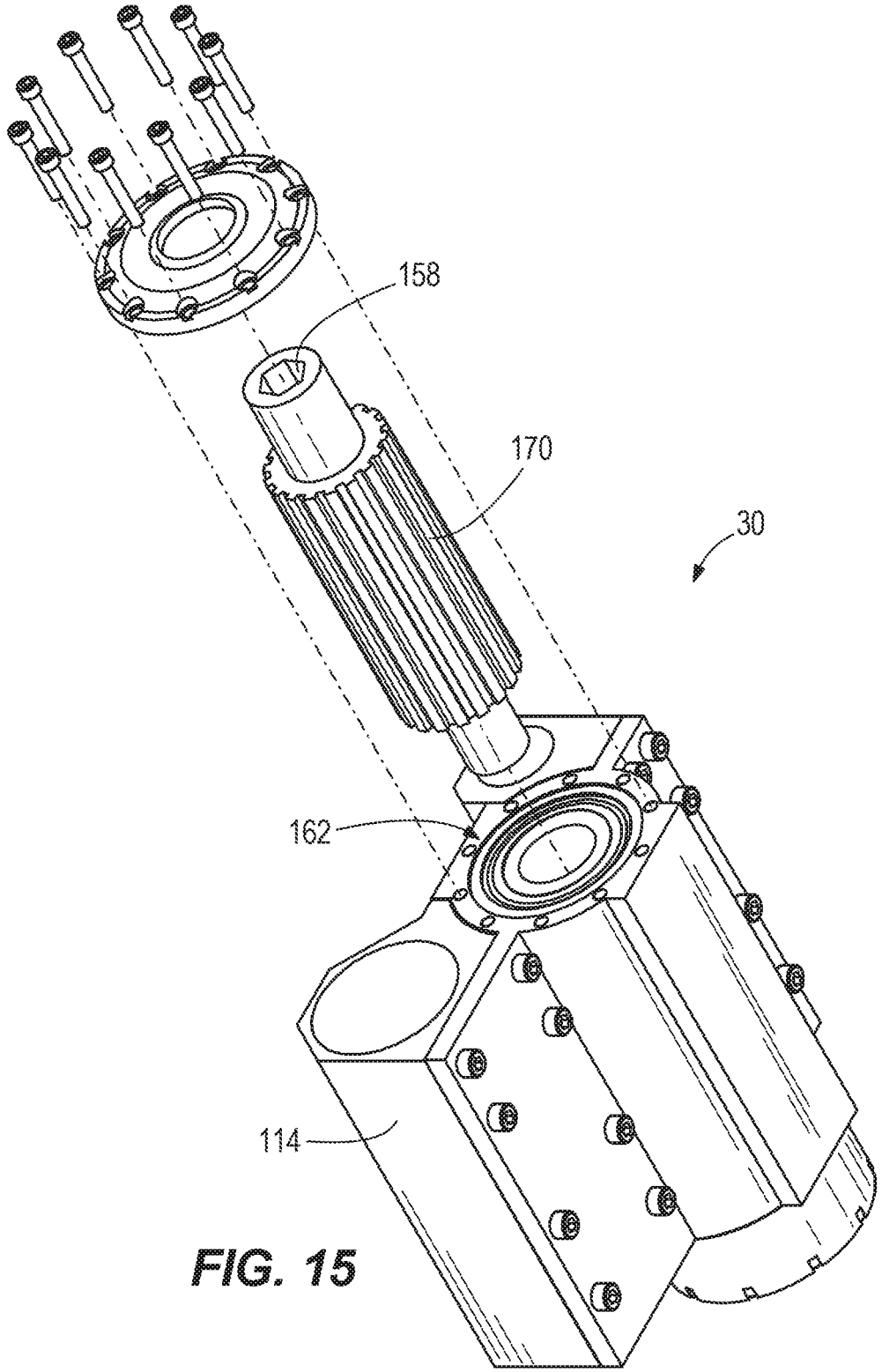
FIG. 15 is an exploded view of a rotation unit.
Figure 16:
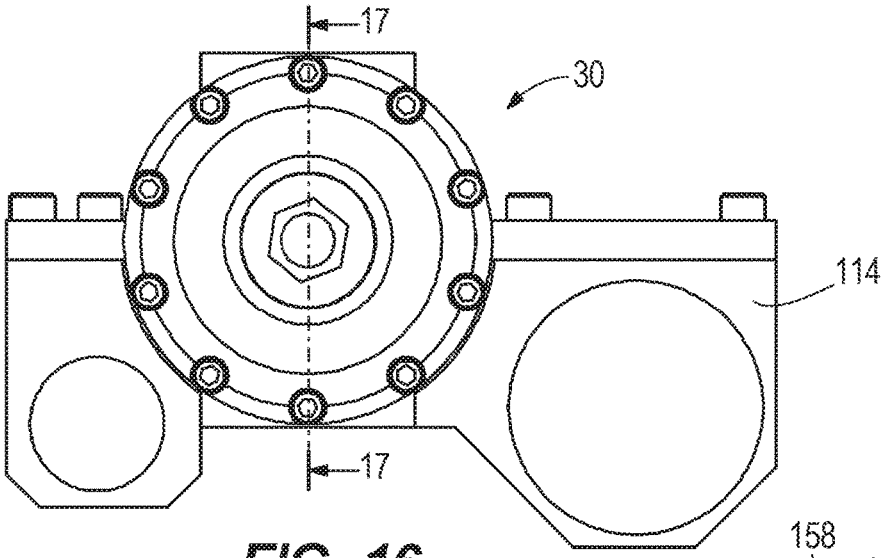
FIG. 16 is a plan view of the rotation unit of FIG. 15.
Figure 17:
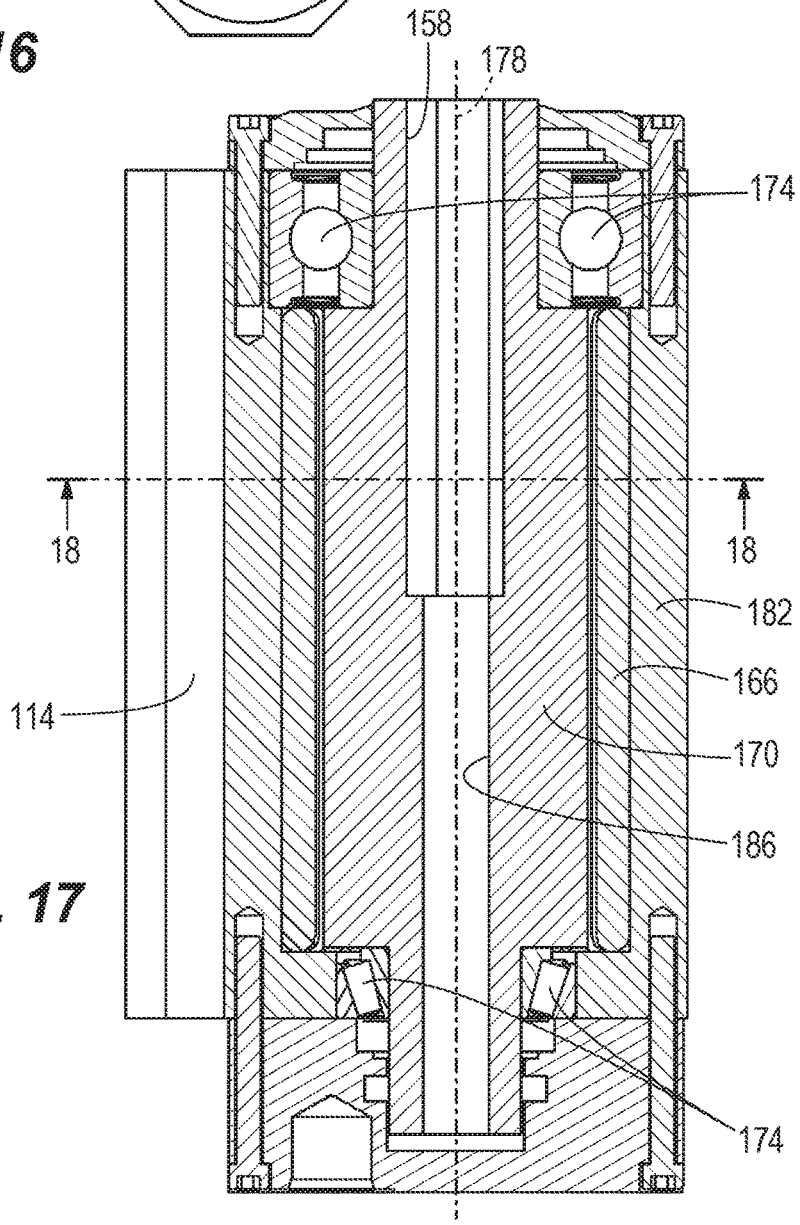
FIG. 17 is a side section view of the rotation unit of FIG. 16, viewed along section 17-17.
Figure 18:
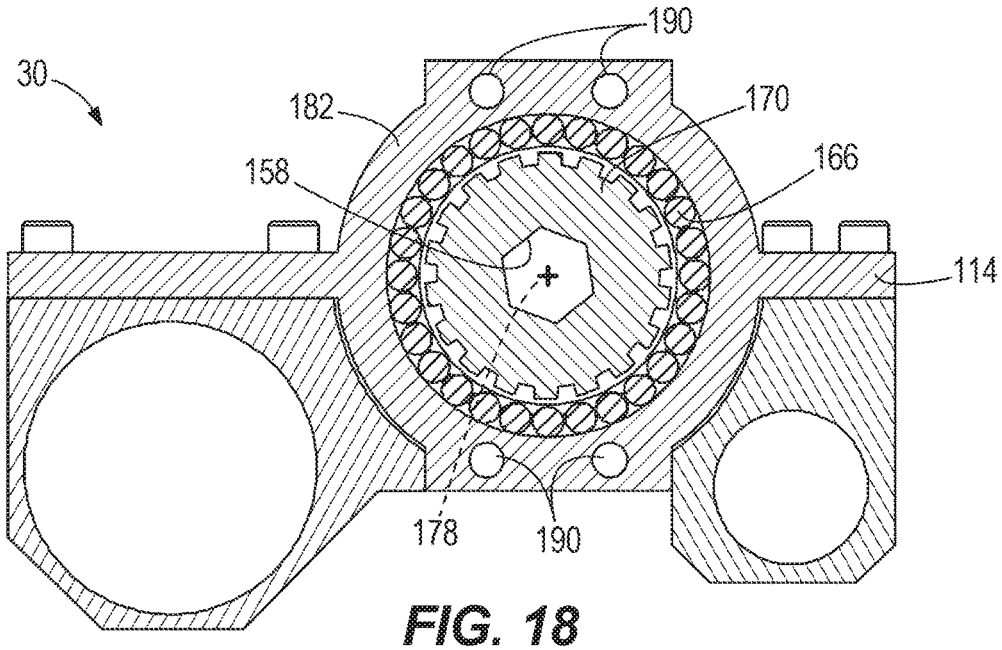
FIG. 18 is a section view of the rotation unit of FIG. 17, viewed along section 18-18.

As shown in FIGS. 15-18, the drive unit or rotation unit 30 is supported on the fed frame 26 (FIG. 3) by a slide block 114. Referring to FIG. 15, the rotation unit 30 includes a chuck 158 for engaging an end of one of the drill bits or bolts 14 (FIG. 2A), and a power source or motor 162 for providing rotational force to the chuck 158. In the illustrated embodiment, the motor 162 is a switched reluctance (SR) motor. In some embodiments, the motor 162 may be an alternating current (AC) motor or permanent magnet motor. Referring to FIGS. 17 and 18, the SR motor includes a stator 166 and a rotor 170 positioned within the stator 166 and supported for rotation relative to the stator 166 (e.g., by bearings 174) about a rotor axis 178. The stator 166 is supported within a housing 182. In the illustrated embodiment, the rotor 170 is formed integrally with the chuck 158 for receiving the drill bit/bolt 14; in other embodiments, the rotor 170 may be directly connected to the chuck 158 in another manner. As shown in FIG. 17, the rotor 170 includes a bore 186 extending through the length of the rotor 170, and a counterbore or step 188 provides an end of the chuck 158. The rotor 170 can be adapted for use with self-drilling bolts, dry vacuum drilling, a through-spindle rod, or a long tendon ground support gripper unit. In addition, the bore 186 acts as a central fluid passageway for fluid (e.g., water or air) used for flushing cut material during the drilling process.

Figure 19:
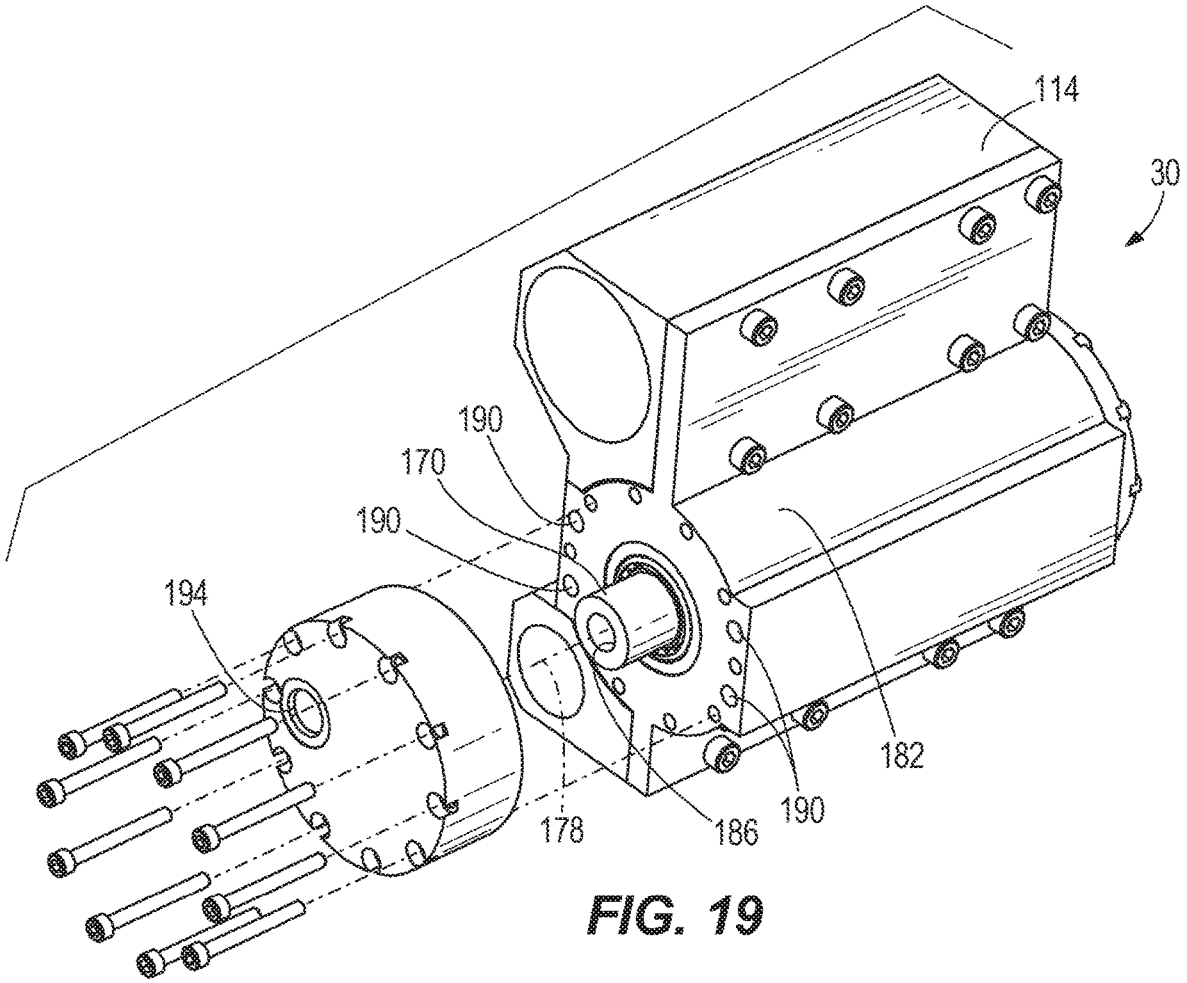
FIG. 19 is an exploded view of a portion of the rotation unit of FIG. 15.
Figure 21:
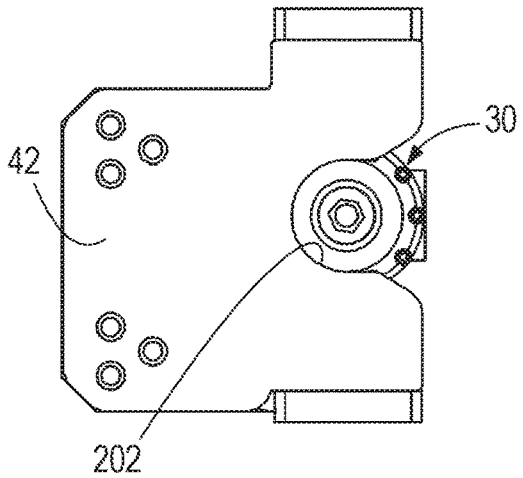
FIG. 21 is a plan view of the drilling and bolting device of FIG. 20.
Figure 20:
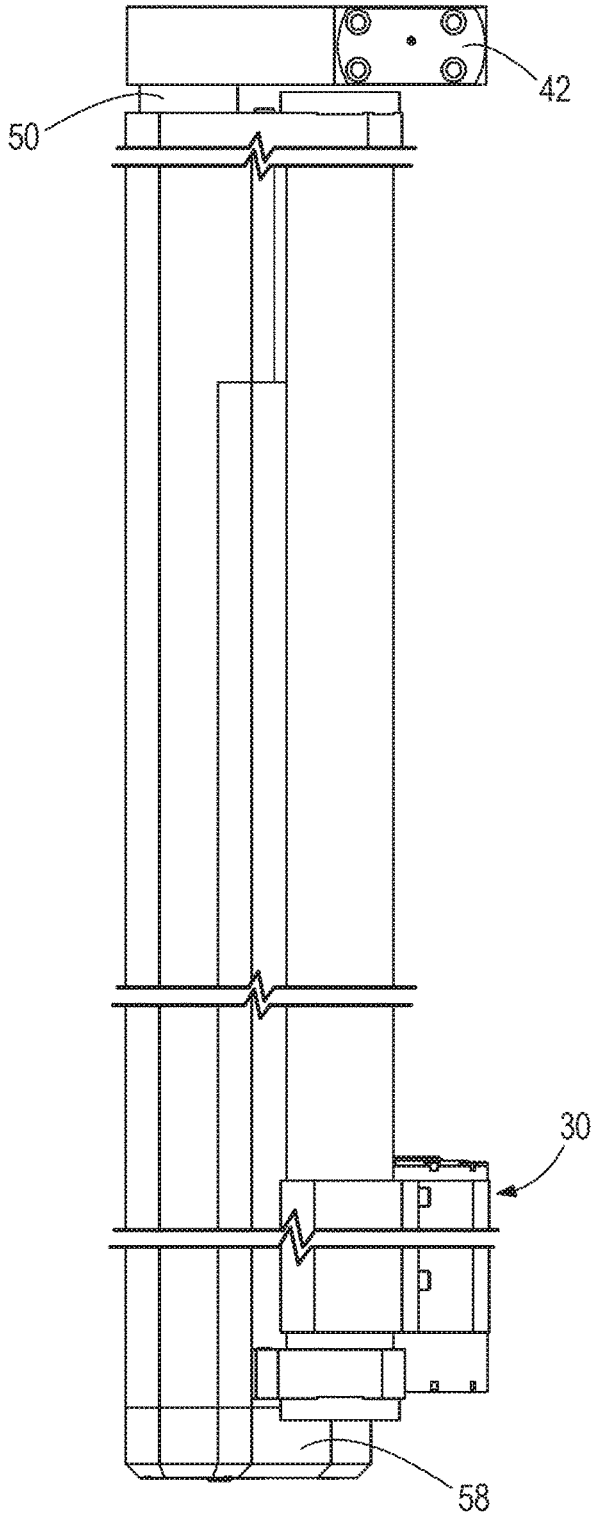
FIG. 20 is a side view of a drilling and bolting device according to another embodiment.

Referring now to FIGS. 18 and 19, the housing 182 includes a plurality of fluid passages 190. A port 194 (FIG. 19) positioned on one end of the housing 182 provides fluid communication between the passages 190 and a fluid source (not shown). In the illustrated embodiment, the passages 190 extend parallel to the rotor axis 178; in other embodiments, the passages 190 may extend through the housing 182 in a different orientation (e.g., the passages may extend in a spiral or helical manner about the rotor axis 178). The passages 190 may provide fluid (e.g., water) for flushing, and/or may provide fluid passing through the housing 182 to cool the stator 166. In other embodiments, the fluid can be air instead of water.

The direct coupling between the rotor 170 and chuck 158 permits a more compact rotation unit 30 than conventional systems, reducing the "dead length" of the drill device 10. The SR motor provides a highly desirable size-to-power-output or length-to-power-output ratio, exhibits lower inertia than conventional systems, and is capable of repeatedly stalling without significant adverse effects on overall motor life. In addition, the bearings 174 are integrated with the chuck 158, supporting the required load for rotating the SR motor and the required loads for drilling and bolting operations.

In some embodiments, the drill device 10 includes a controller for providing accurate control of various functions. For example, the controller may prevent jamming of the bit 14 and may impose a maximum penetration rate during a drilling operation. In addition, the controller may automate bolt insertion, mixing of resin chemicals, nut torqueing, and logging, without the need for external sensing and control technology that is required for conventional hydraulic systems.

Figure 22:
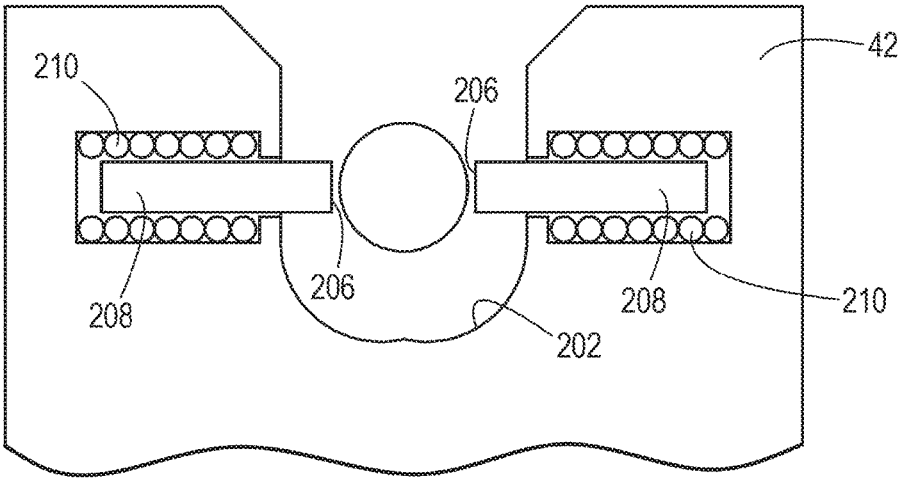
FIG. 22 is an enlarged view of a gripping device.

As shown in FIG. 22, the gripping device 48 in the upper block 42 holds and guides drill bits/bolts 14 as they pass through an opening 202 in the upper block 42 and into a rock surface or mine surface. The gripping device 48 may include a pair of grip members 206 including solenoid rods 208 positioned in coils 210 on either side of the opening 202. In some embodiments, a controller (not shown) extends and retracts the solenoids 208 as necessary to exert a desired gripping force on the bolt 14.

In addition to controlling the gripping of the bolt/rod, the controller may control the positioning of the drill device. In some embodiments, the controller may provide automatic control of various electric actuators and may control an insertion and penetration rate of the bolt/bit, and may control mixing, nut torqueing, and logging. The controller may protect against jamming of the device.

Figure 23:
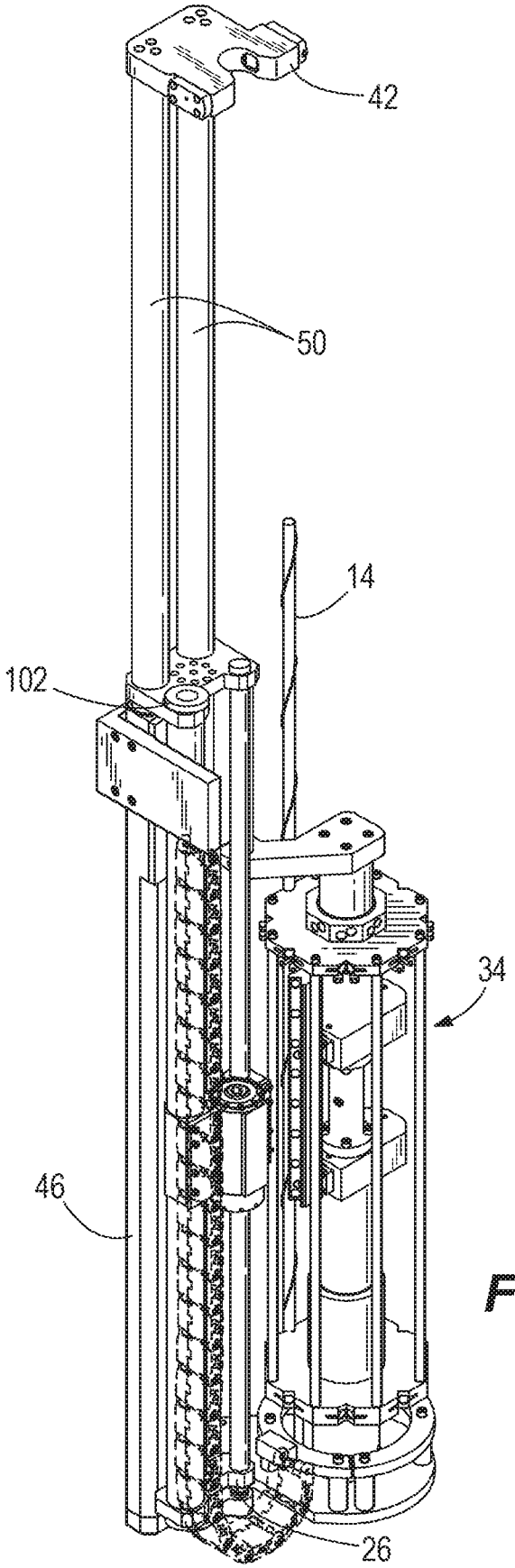
FIG. 23 is a perspective view of a drilling and bolting device with a base in an extended position.

In addition, the controller may control the position of the upper block 42 relative to the rock surface during drilling and bolt insertion processes. As illustrated in FIG. 23, the upper block 42 is extendable and retractable relative to the lower block 46. The position and velocity feedback is intrinsic to the SR motor and the grip members, and can be configured in an open loop or closed loop manner. This eliminates the need for external sensors and/or switches, which are susceptible to damage and failure in an underground mining environment.

Figure 24:
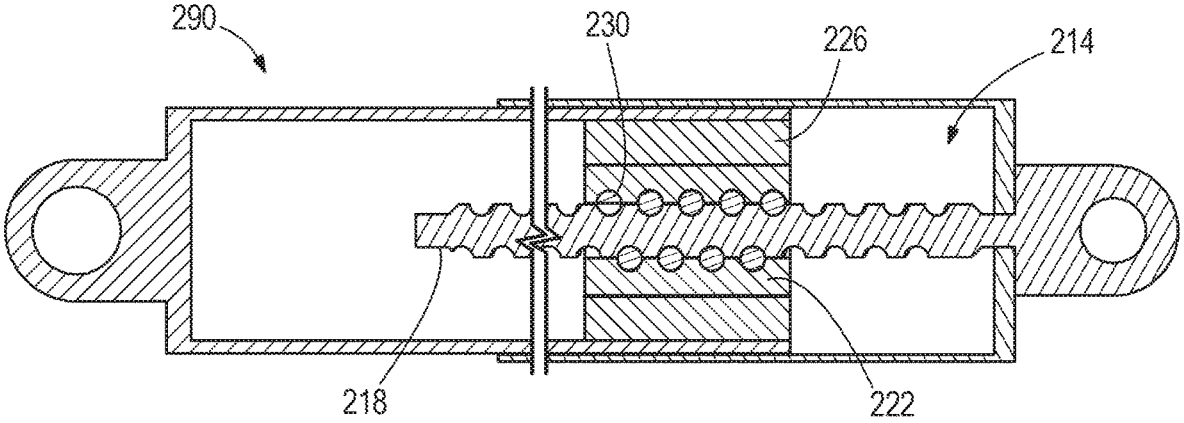
FIG. 24 is a section view of an actuator for moving the drilling and bolting device.

Referring again to FIG. 1B, the machine 4 includes a linear actuator 290 for moving the drill device 10 relative to the boom 8. The linear actuator 290 positions the drill device or indexes the drill device 10 from one bolting position to another bolting position. As shown in FIG. 24, in some embodiments, the linear actuator 290 may include a ball screw device 214 in which an SR motor drives a shaft 218 to extend and retract the linear actuator 290. The SR motor may include a rotor 222 positioned within a stator 226, and the rotor 222 includes reticulating balls 230 that engage the shaft 218. As the rotor 222 rotates, the shaft 218 extends and retracts relative to the rotor 222, thereby extending and retracting the actuator 290.

Figure 25:
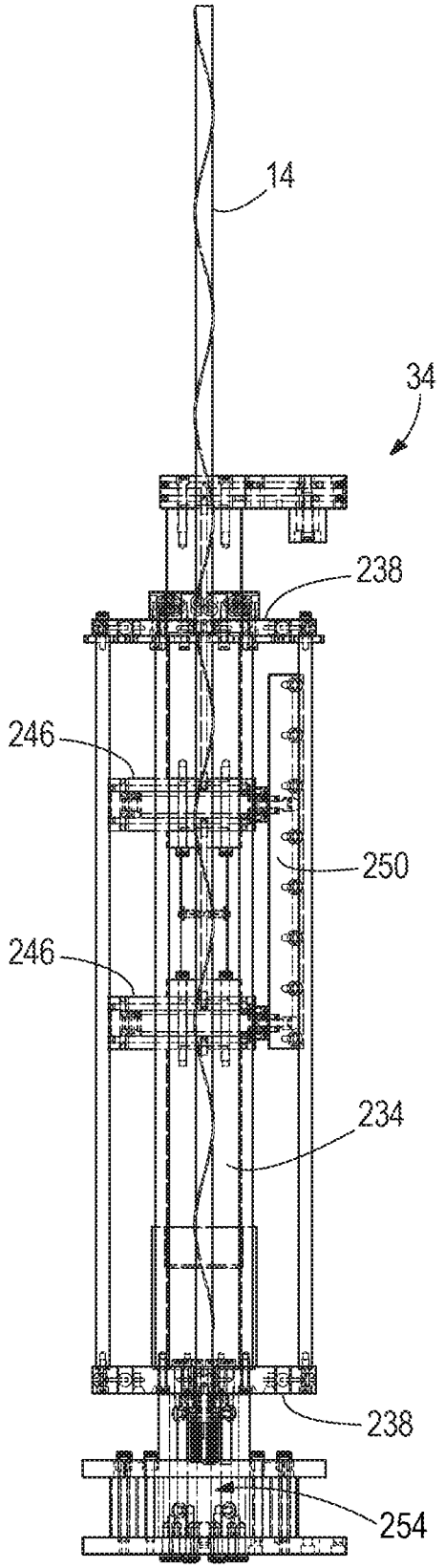
FIG. 25 is a side view of the carousel of FIG. 2A.
Figure 26:
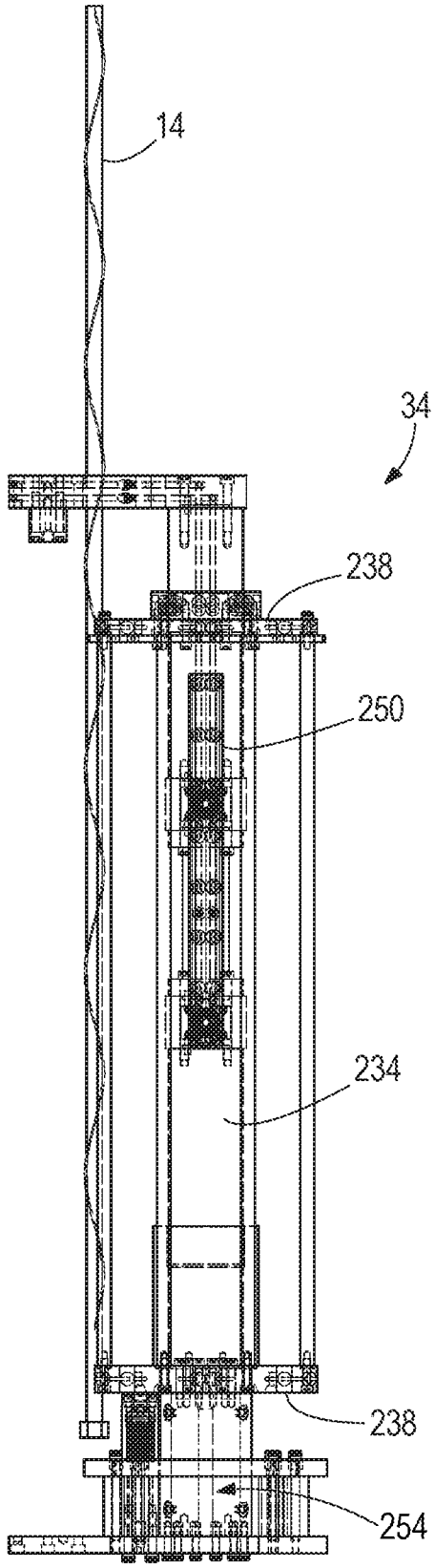
FIG. 26 is another side view of the carousel of FIG. 25.

As shown in FIGS. 25 and 26, the carousel 34 includes a mast 234 and discs 238 coupled to the mast 234. Each disc 238 includes a plurality of openings positioned along an outer periphery. A bolt 14 is positioned in each opening. The carousel 34 further includes presenters or arms 246 that are extendable relative to the mast 234. A transfer bar 250 is supported on the arms 246, and the transfer bar 250 may include multiple magnets to secure the bolt 14 to the bar 250. The transfer bar 250 engages one of the bolts 14 and transfers it to the chuck 158 of the rotation unit 30 (FIG. 15). When the bolt 14 is engaged by the chuck 158 and the grip members 206 (FIG. 22), the arms 246 are retracted, thereby disengaging the transfer bar 250 from the bolt 14. Nonmetallic items, such as resin or glue capsules, may be contained within a metallic holder so that the magnets of the transfer bar 250 are effective. In some embodiments, the carousel 34 may include electric solenoids (not shown) for gripping a rod or bolt 14, and may include a rotary indexer 254 for controlling the position of the disc 238 or transfer bar 250.

FIGS. 27-32 illustrate a drill device 410 according to another embodiment. The drill device 410 is similar to the drill device 10, and similar features are identified with similar reference numbers, plus 400.

Figure 27:
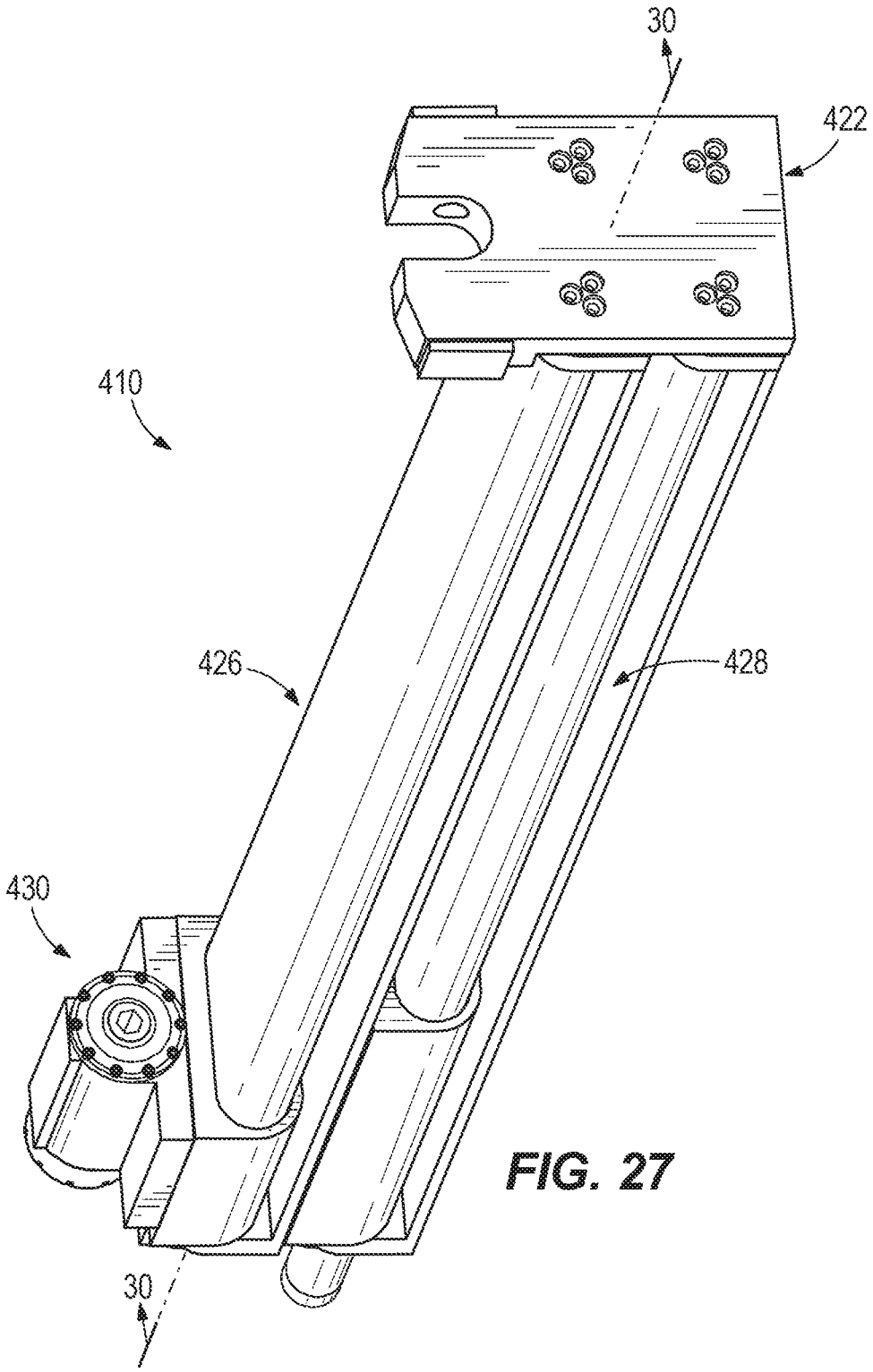
FIG. 27 is a perspective view of a drilling and bolting device according to another embodiment.
Figure 28:
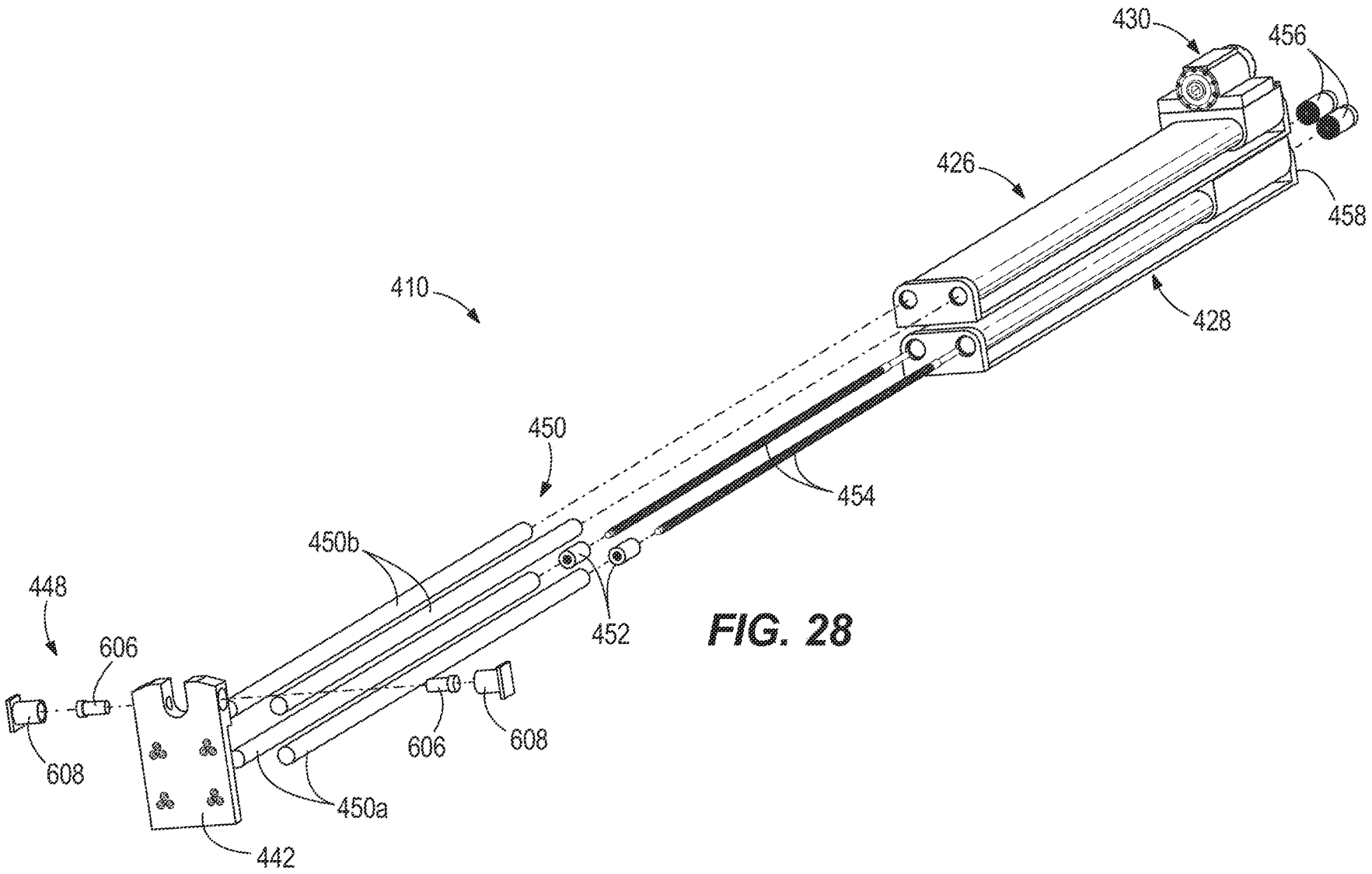
FIG. 28 is a partially exploded view of the drilling and bolting device of FIG. 27.

As shown in FIG. 27, the drill device 410 includes a first stage or base 422, a second stage or feed frame 426, a feed frame carrier 428, and a drive unit or rotation unit 430. Referring now to FIG. 28, the base 422 includes an end plate or upper block 442 and first rods or base rods 450. The upper block 442 is coupled to ends of the base rods 450 and includes a gripping device 448 including a pair of grip members 606 driven by electrical solenoids 608.

A pair of the base rods 450*a* are supported for slidable movement relative to the feed frame carrier 428. In addition, the base 422 includes a pair of feed nuts 452, feed screws 454, and feed drives 456. Each feed nut 452 is secured to an end of an associated base rod 450*a*. Each feed screw 454 extends through the feed frame carrier 428 and is threadably coupled to the associated feed nut 452. An end of each feed screw 454 is coupled to an associated one of the feed drives 456 proximate a second end plate 458. In the illustrated embodiment, each feed drive 456 is an SR motor; in other embodiments, each feed drive 456 may include a different type of motor.

The feed drives 456 rotate the feed screws 454 to thread the feed screws 454 relative to the feed nuts 452. As a result, the feed nuts 452 and base rods 450*a* move along the axes of the feed screws 454. Additional base rods 450*b* may extend into the feed frame 426 to provide additional guidance and/or torque support.

Figure 29:
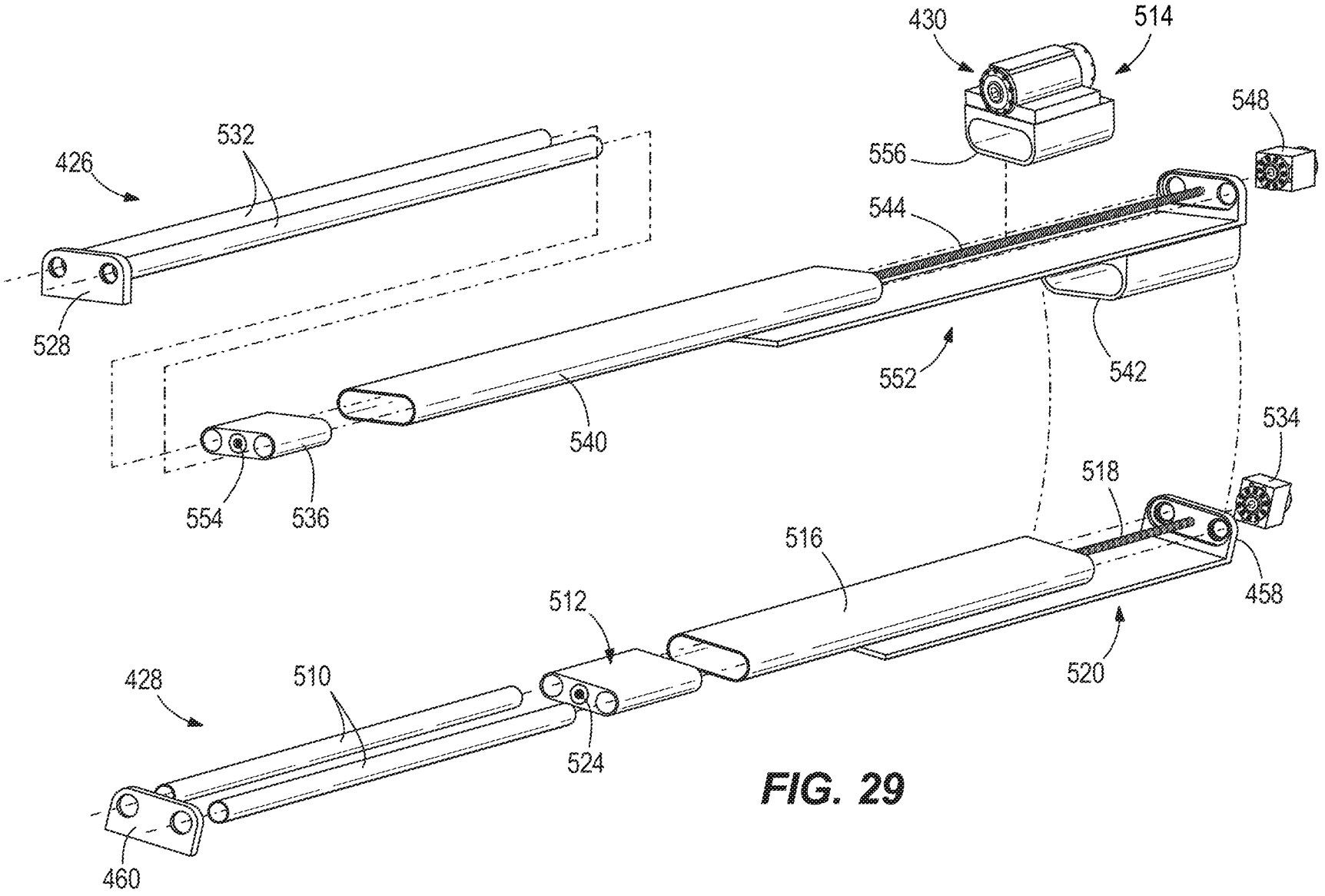
FIG. 29 is an exploded view of a portion of the drilling and bolting device of FIG. 27.
Figure 30:
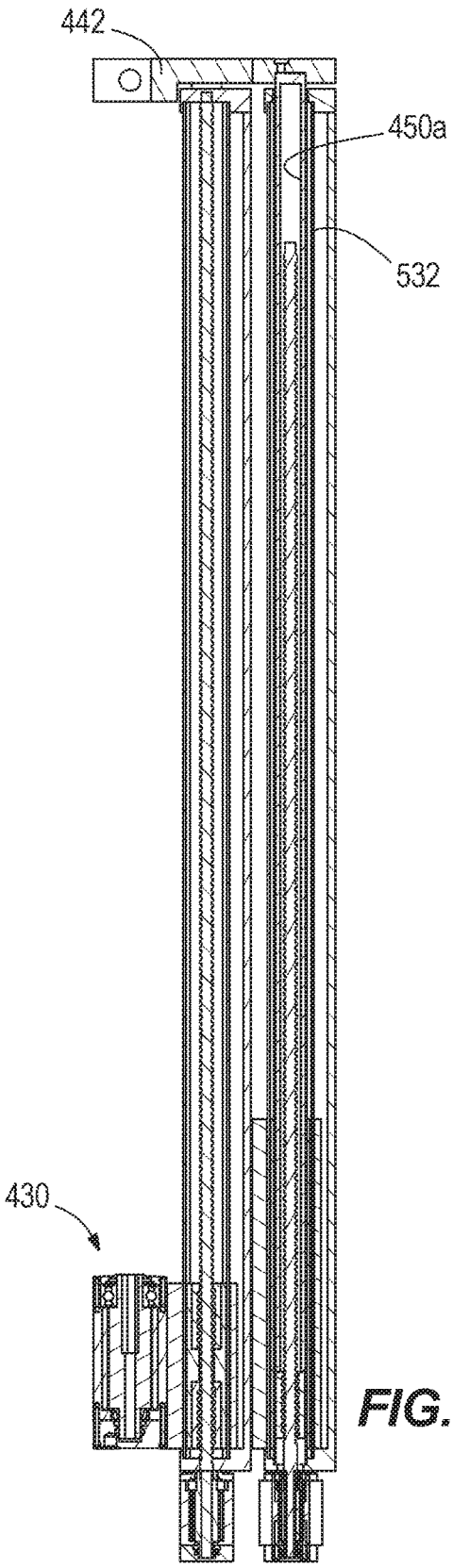
FIG. 30 is a section view of the drilling and bolting device of FIG. 27, viewed along section 30-30.
Figure 31:
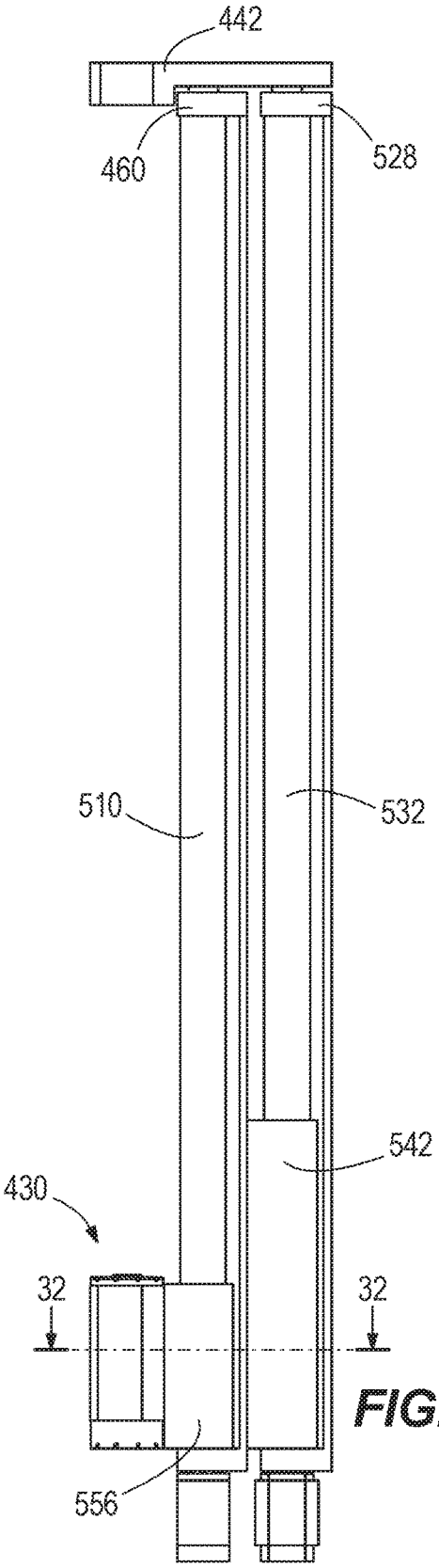
FIG. 31 is a side view of the drilling and bolting device of FIG. 27.

As shown in FIG. 29, the feed frame carrier 428 includes a carrier end plate 460, carrier torsion bars 510, a first motivator or carrier motivator 512, a first guide member or carrier guide member 516, a carrier screw 518, and a carrier drive 534. One end of each carrier torsion bar 510 is secured to the carrier end plate 460, and the carrier torsion bars 510 extend through the carrier guide member 516. In the illustrated embodiment, an opposite end of each carrier torsion bar 510 is secured to the second end plate 458 (e.g., provided on a carrier bracket 520).

The carrier motivator 512 is positioned within the carrier guide member 516. The carrier motivator 512 is slidably coupled to the carrier torsion bars 510 and is movable along the bars 510 within the carrier guide member 516. In addition, the carrier screw 518 extends from the carrier bracket 520 at least partially through the carrier guide member 516. The carrier motivator 512 includes a threaded bore 524 for threadably receiving the carrier screw 518. The carrier drive 534 is secured to the carrier bracket 520 and drives one end of the carrier screw 518. In the illustrated embodiment, the carrier drive 534 is an SR motor; in other embodiments, the carrier drive 534 may include a different type of motor. As the carrier screw 518 rotates, the carrier motivator 512 slides along the carrier torsion bars 510. The carrier motivator 512 includes a magnet (e.g., a permanent magnet).

The feed frame 426 includes a feed frame end plate 528, second torsion bars or rotation unit torsion bars 532, a second motivator or rotation unit motivator 536, a second guide member or rotation unit guide member 540, a feed frame support 542, a rotation unit feed screw 544, and rotation unit feed drive 548. One end of each rotation unit torsion bar 532 is secured to the feed frame end plate 528, and the rotation unit torsion bars 532 extend through the rotation unit guide member 540. In the illustrated embodiment, an opposite end of each rotation unit torsion bar 532 and the feed frame support 542 are secured to a feed frame bracket 552. The feed frame support 542 engages (e.g., receives) the carrier guide member 516. The magnet of the carrier motivator 512 is magnetically coupled to the feed frame support 542. As the carrier motivator 512 slides along the carrier guide member 516, the feed frame support 542 is driven to slide along the carrier guide member 516.

The rotation unit motivator 536 is positioned within the rotation unit guide member 540. The rotation unit motivator 536 is slidably coupled to the rotation unit torsion bars 532 and is movable along the bars 532 within the rotation unit guide member 540. In addition, the rotation unit feed screw 544 extends from the feed frame bracket 552 and at least partially through the rotation unit guide member 540. The rotation unit motivator 536 includes a threaded bore 554 for threadably receiving the rotation unit feed screw 544. The rotation unit feed drive 548 is secured to the feed frame bracket 552 and drives one end of the rotation unit feed screw 544. In the illustrated embodiment, the rotation unit feed drive 548 is an SR motor; in other embodiments, the rotation unit feed drive 548 may include a different type of motor. As the rotation unit feed screw 544 rotates, the rotation unit motivator 536 slides along the rotation unit torsion bars 532.

The drive unit or rotation unit 430 is coupled to a slide block 514 including a rotation unit support 556. The rotation unit support 556 engages (e.g., receives) the rotation unit guide member 540. The rotation unit motivator 536 includes a magnet (e.g., a permanent magnet) and is magnetically coupled to the rotation unit support 556. As the rotation unit motivator 536 slides along the rotation unit guide member 540, the rotation unit support 556 is driven to slide along the rotation unit guide member 540. The rotation unit 430 and the feed frame 426 can be actuated simultaneously or sequentially by energizing the rotation unit feed drive 548 and the carrier drive 534, respectively, simultaneously or sequentially.

Figure 32:
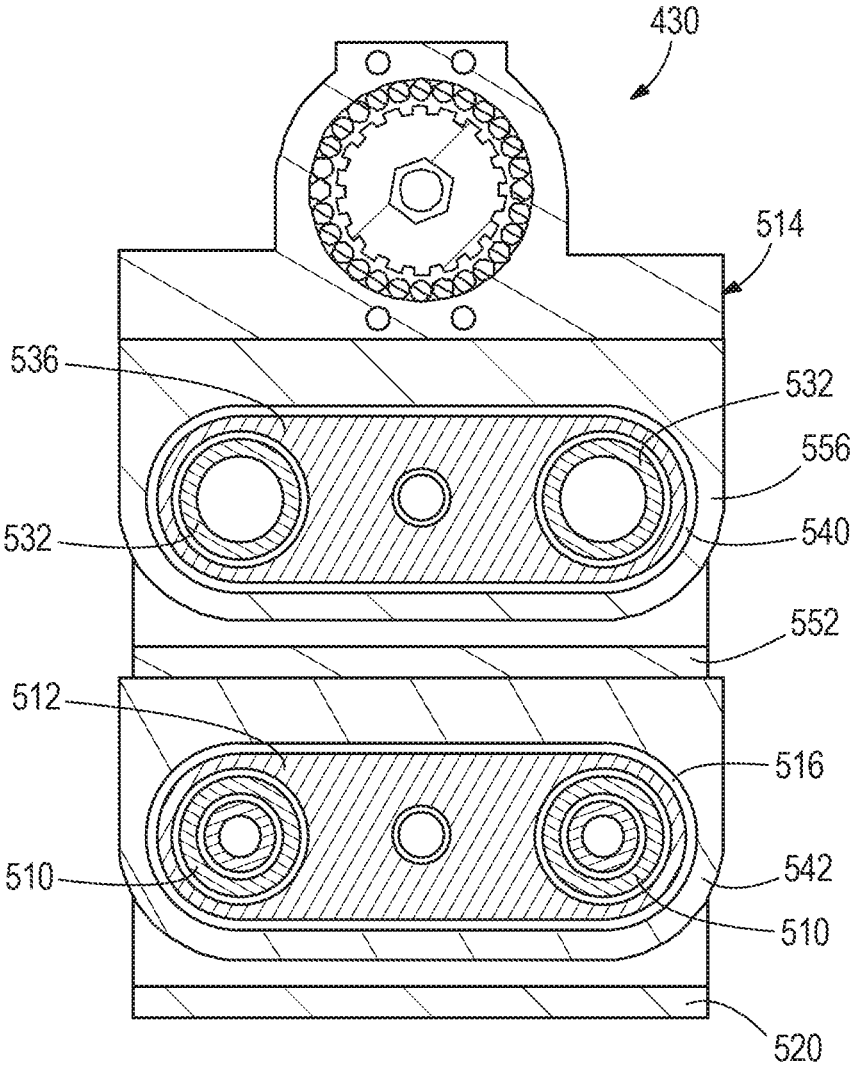
FIG. 32 is a section view of the drilling and bolting device of FIG. 27, viewed along section 32-32.

As shown in FIG. 32, each of the carrier motivator 512 and rotation unit motivator 536 has an elongated or non-circular or eccentric profile as viewed along the feed axis. The motivators 512, 536 have a larger size than a cylindrical motivator, thereby providing a greater magnetic force and flux density than a cylindrical motivator. In addition, the drill device 410 is actuated using only electric (or electromagnetic) energy.

FIGS. 33-41 illustrate a drill device 810 according to another embodiment. The drill device 810 is similar to the drill device 10, and similar features are identified with similar reference numbers, plus 800.

Figure 33:
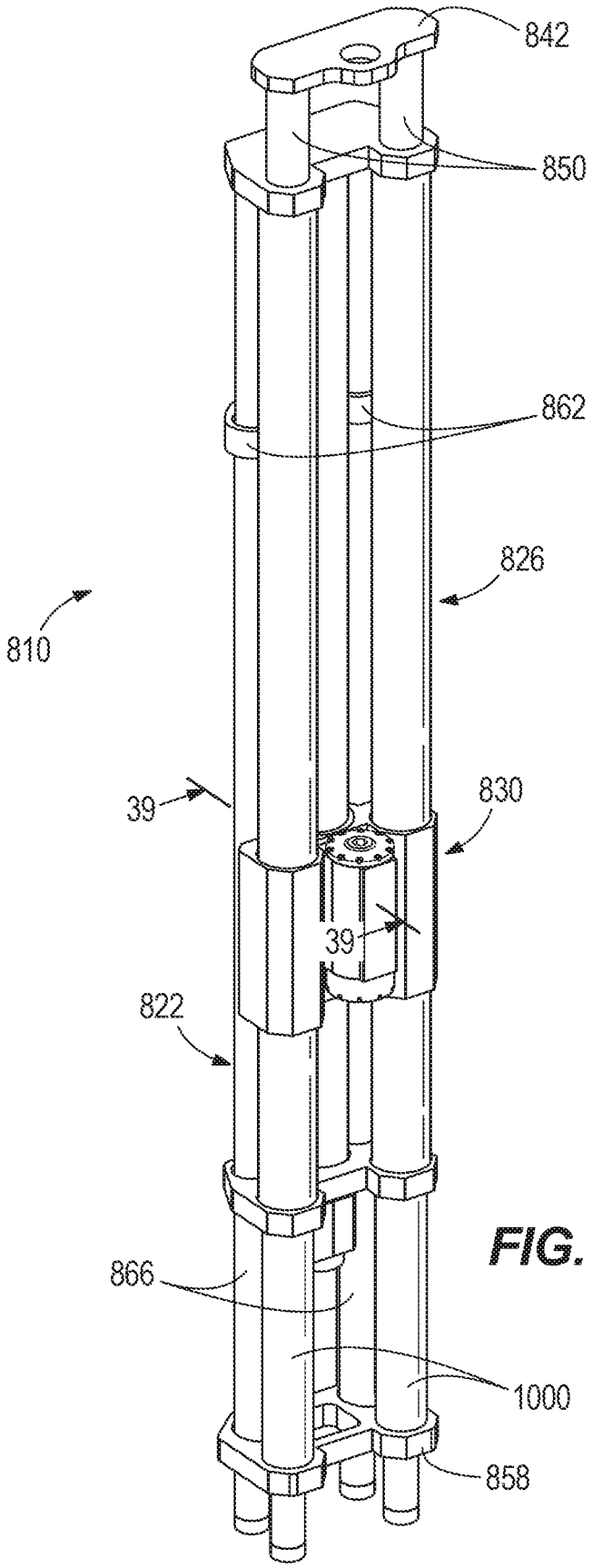
FIG. 33 is a perspective view of a drilling and bolting device according to another embodiment.
Figure 34:
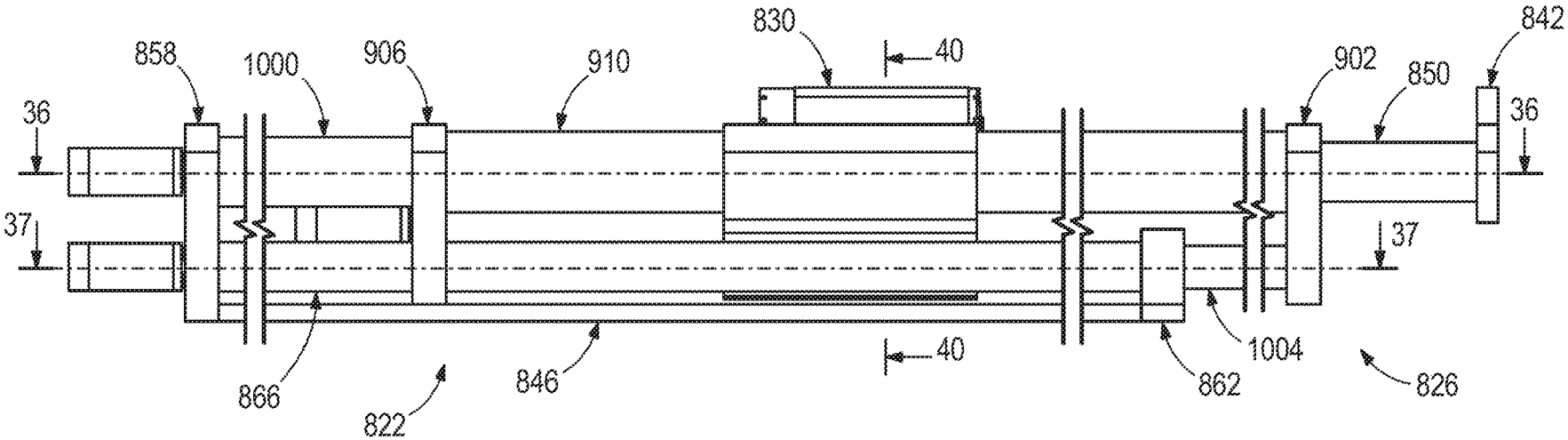
FIG. 34 is a side view of the drilling and bolting device of FIG. 33.

As shown in FIGS. 33 and 34, the drill device 810 includes a first stage or base 822, a feed frame 826 and a drive or rotation unit 830. The base 822 includes a pair of guide bars 866 that extend from an end plate 858 to a stop member 862, and a pair of hollow bars 1000 are connected to the end plate 858. The hollow bars 1000 are coupled to base bars 850, and the base bars 850 are slidable within the hollow bars 1000.

Figure 36:
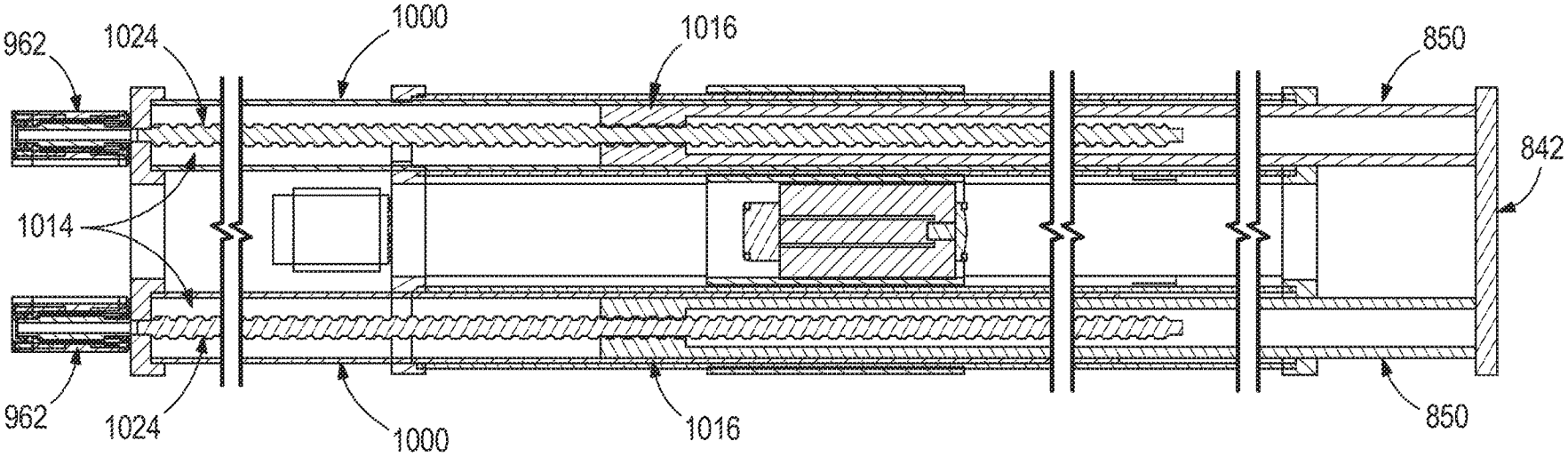
FIG. 36 is a section view of the drilling and bolting device of FIG. 34, viewed along section 36-36.

Referring now to FIG. 36, each hollow bar 1000 houses a first stage drive unit or linear actuator. In the illustrated embodiment, each first stage linear actuator includes a first stage ball screw device 1014 and a first stage motor 962 (e.g., an SR motor) driving the first stage ball screw device 1014. The first stage ball screw device 1014 includes a first stage drive nut 1016 secured to an end of an associated one of the base bars 850. Each first stage drive nut 1016 engages a threaded shaft 1024. Each first stage drive nut 1016 may include reticulating balls (e.g., similar to the reticulating balls illustrated in FIG. 24). Actuation of the first stage motors 962 rotates the shafts 1024 to move the base bars 850, thereby moving an upper block 842 toward or away from a lower block 846.

Figure 35:
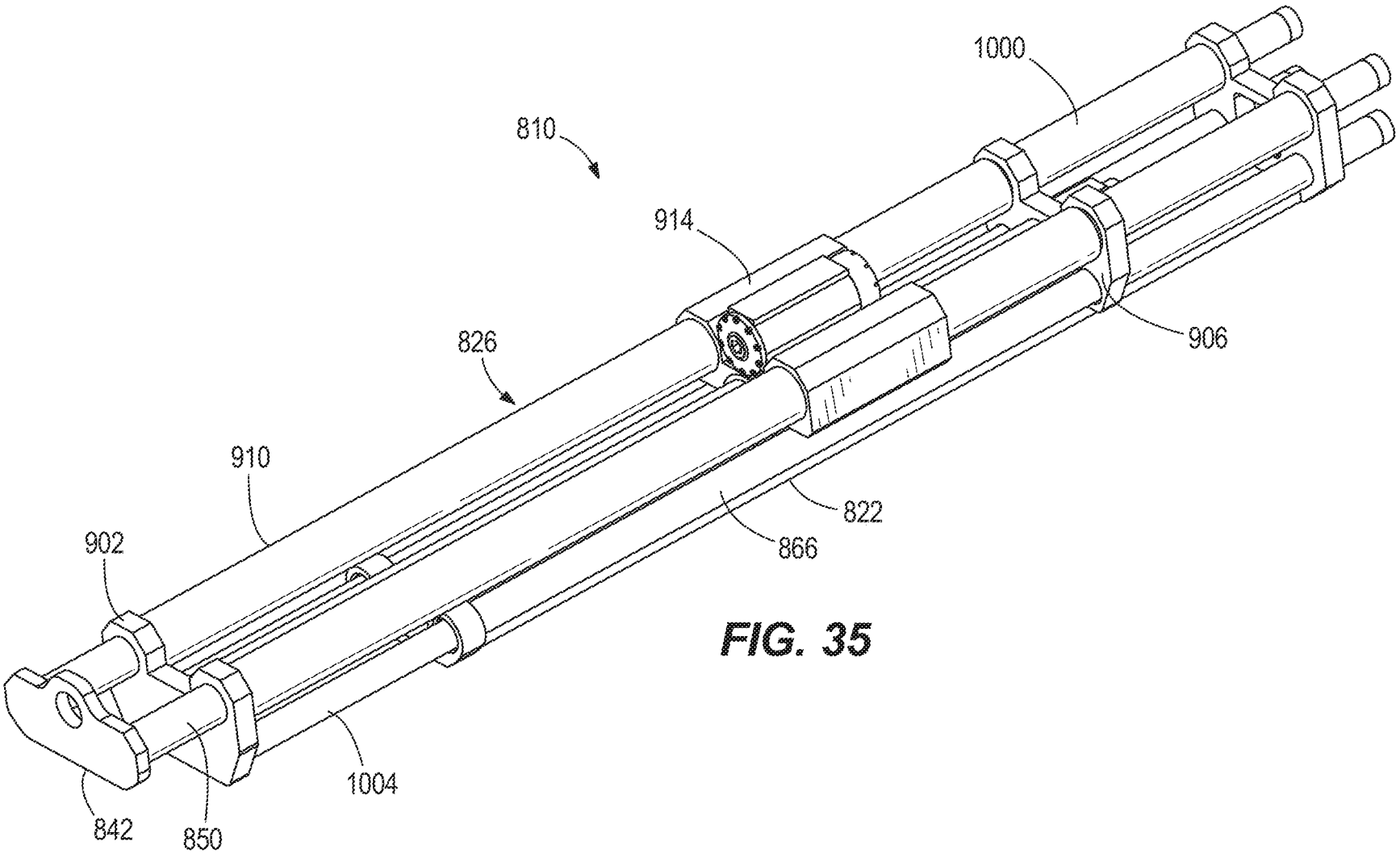
FIG. 35 is a perspective view of the drilling and bolting device of FIG. 33.
Figure 37:
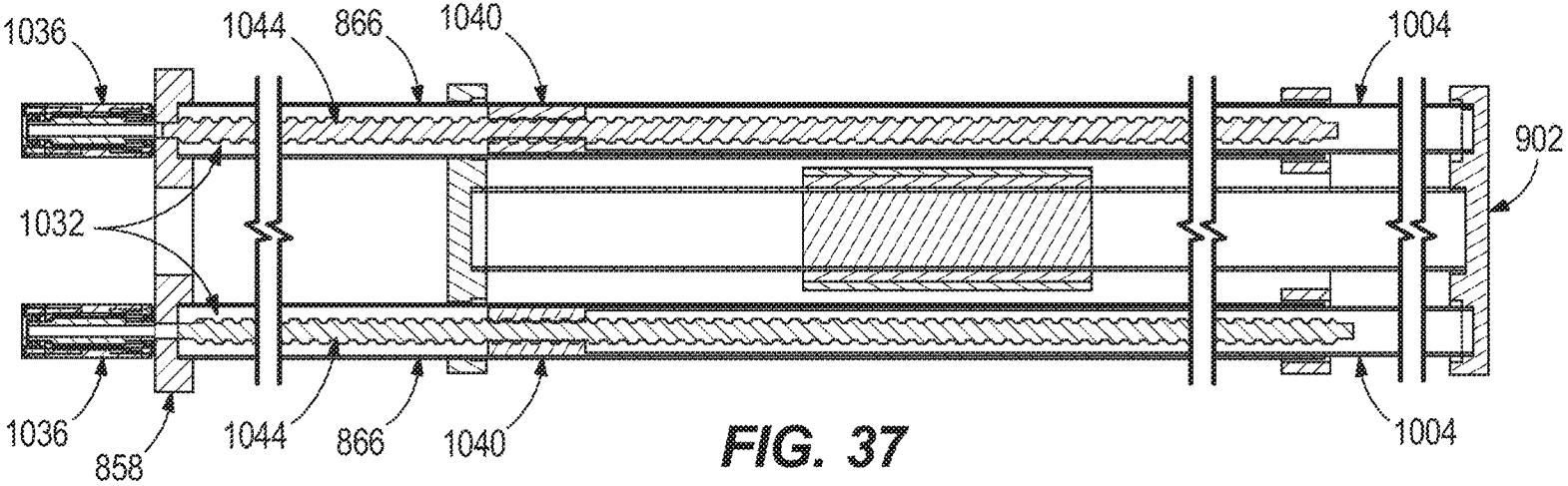
FIG. 37 is a section view of the drilling and bolting device of FIG. 34, viewed along section 37-37.
Figure 38:
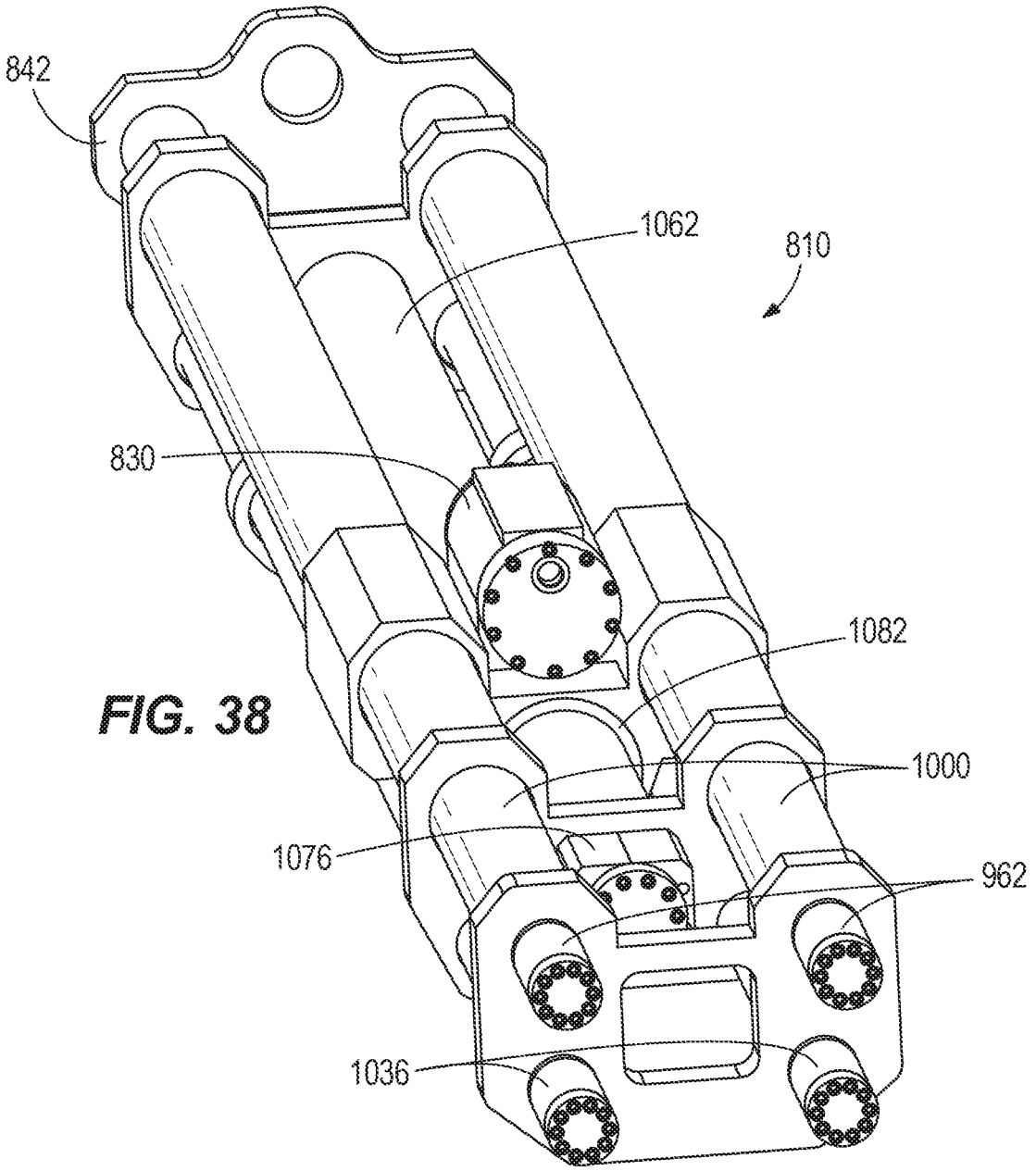
FIG. 38 is a perspective view of the drilling and bolting device of FIG. 33.

As shown in FIGS. 34 and 35, the feed frame 826 includes an upper feed block 902, a lower feed block 906, a pair of feed extension bars 1004, a pair of feed bars 910 and a slide block 914 movably coupled to the feed bars 910. The feed bars 910 are coupled to the base bars 850 and the hollow bars 1000. Feed extension bars 1004 are coupled to the guide bars 866 and are slideable within the guide bars 866. Referring to FIG. 37, each of the guide bars 866 houses a second stage drive unit or linear actuator. In the illustrated embodiment, each second stage linear actuator includes a second stage ball screw device 1032 and a second stage motor 1036 (e.g., an SR motor) driving the second stage ball screw device 1032. The second stage ball screw device 1032 includes a second stage drive nut 1040 secured to an end of an associated one of the feed extension bars 1004. Each second stage drive nut 1040 engages a threaded shaft 1044. Each second stage drive nut 1040 may include reticulating balls (e.g., similar to the reticulating balls illustrated in FIG. 24). Actuation of the second stage motors 1036 rotates the shafts 1044 to move the feed frame 826 toward or away from the upper block 842. In some embodiments, the upper feed block 902 may include guide bearings (not shown) engaging the base bars 850, and the lower feed block 906 may include guide bearings (not shown) engaging the hollow bars 1000.

Figure 39:
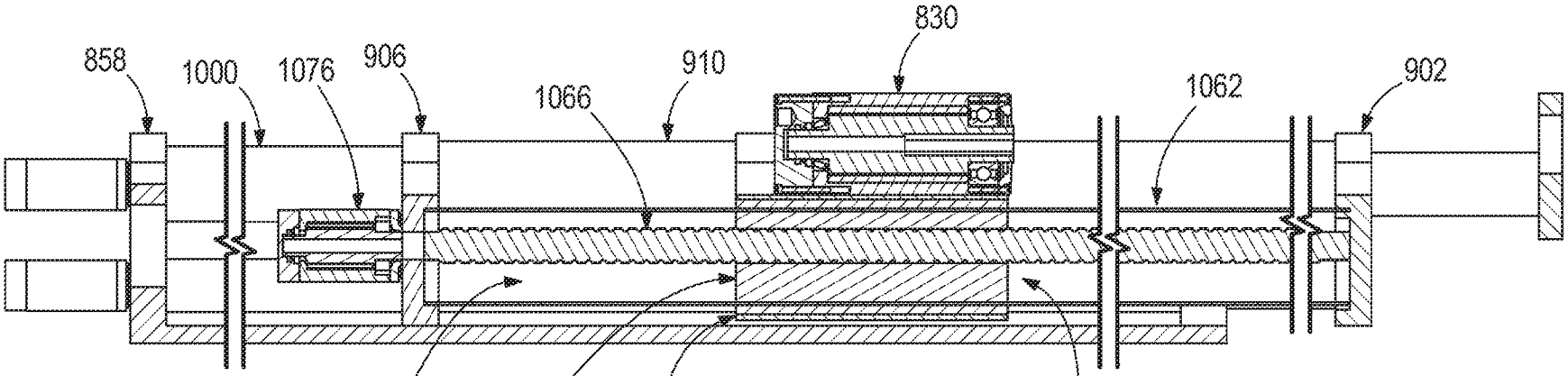
FIG. 39 is a section view of the drilling and bolting device of FIG. 33, viewed along section 39-39.

As best shown in FIG. 39, the feed frame 826 further includes a tube 1062 connected to the upper feed block 902 and the lower feed block 906. The tube 1062 houses a third stage drive unit or linear actuator including a third stage ball screw device 1072, a third stage motor 1076 (e.g., an SR motor) driving the third stage ball screw device 1072, and a first or inner magnet array 1078. The third stage ball screw device 1072 includes a threaded shaft 1066, and the inner magnet array 1078 is threadably coupled to the shaft 1066.

Figure 40:
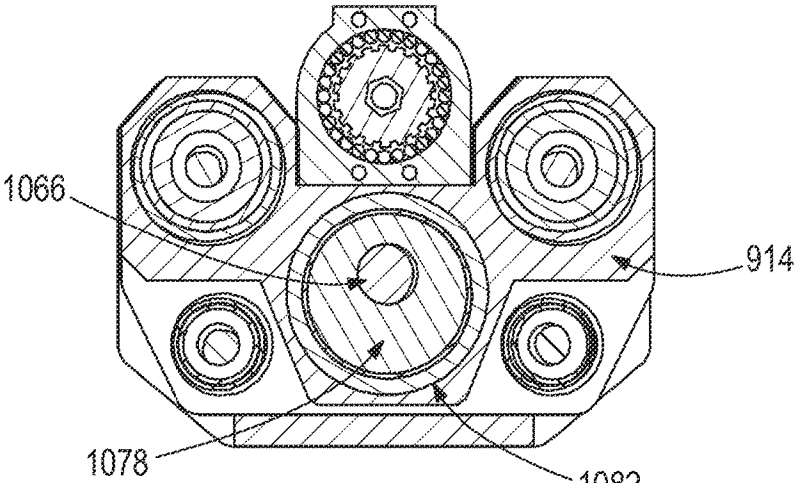
FIG. 40 is a section view of the drilling and bolting device of FIG. 34, viewed along section 40-40.
Figure 41:
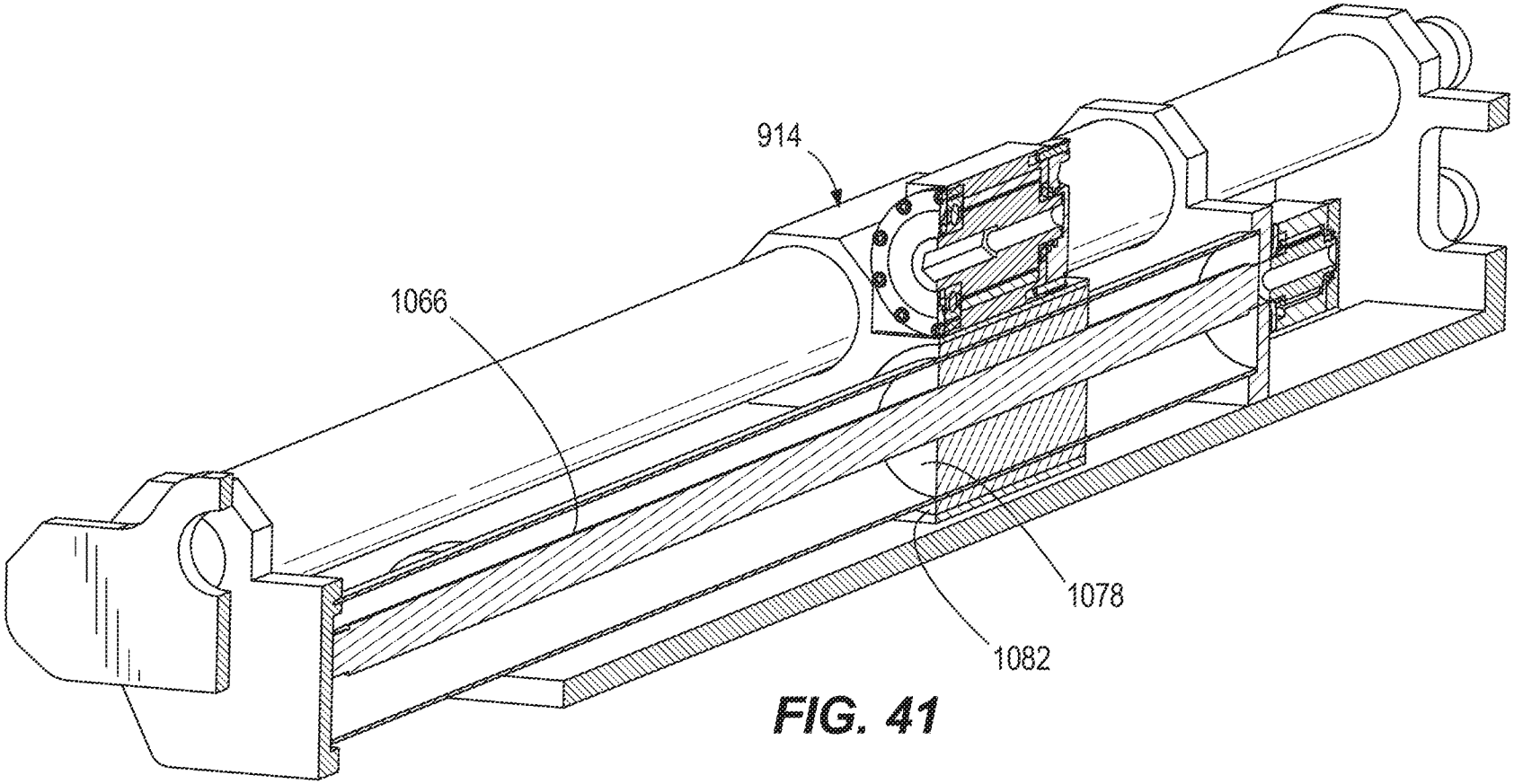
FIG. 41 is a perspective view of the section of the drilling and bolting device shown in FIG. 39.

A slide block 914 includes a corresponding second or outer magnet array 1082, with the magnetic north and south poles oriented opposite the magnetic north and south poles of the inner magnet array 1078 so that movement of the inner magnet array 1078 along the length of the tube 1062 will cause the outer magnet array 1082 and slide block 914 to be carried with it along the feed bars 910. In some embodiments, the inner magnet array 1078 and outer magnet array 1082 include rare earth magnets; in other embodiments, the arrays 1078, 1082 include other types of magnets. The magnet arrays are further arranged so that they will be prevented from independently rotating about their longitudinal axes. As shown in FIGS. 40 and 41, the inner magnet array 1078 and outer magnet array 1082 are mounted eccentrically, their respective longitudinal axes being offset from the longitudinal axis of the third stage ball screw device 1072. The eccentricity or offset in axes provides torsional resistance and inhibits revolution of the inner magnet array 1078, while permitting rotation about the shaft 1066.

Although various aspects have been described in detail with reference to certain preferred embodiments, variations and modifications exist within the scope and spirit of one or more independent aspects as described. Various features and advantages are set forth in the following claims.

What is claimed is:

1. A drilling and bolting device comprising:

a frame;

a drive unit supported for movement relative to the frame, the drive unit including a block, a motor supported on the block, and a chuck for receiving a drill element, the chuck driven by the motor; and an actuator for moving the drive unit relative to the frame, the actuator including a magnet exerting a magnetic force on the block to provide magnetic coupling between the actuator and the block, wherein the block moves in response to movement of the magnet.

2. The drilling and bolting device of claim 1, wherein the frame is a feed frame supported for movement along an extendable base frame.

3. The drilling and bolting device of claim 1, wherein the frame is a base frame, the drilling and bolting device further comprising a feed frame supported for movement relative to the base frame along a feed axis, wherein operation of the actuator moves the feed frame relative to the base frame, wherein the drive unit is directly supported on the feed frame.

4. The drilling and bolting device of claim 1, wherein the actuator further includes an elongated threaded shaft and the magnet is threadably coupled to the threaded shaft, the threaded shaft oriented parallel to a feed axis, rotation of the threaded shaft causing the magnet to move along the threaded shaft, the movement of the magnet causing corresponding movement of the block parallel to the feed axis.

5. The drilling and bolting device of claim 4, wherein the threaded shaft is driven by an electric motor.

6. The drilling and bolting device of claim 4, wherein the magnet is eccentrically mounted with respect to the threaded shaft, a center of the magnet being offset from the threaded shaft.

7. The drilling and bolting device of claim 1, wherein the magnet is movable in a direction parallel to a feed axis, the magnet having a non-circular cross-section.

8. The drilling and bolting device of claim 1, wherein the magnet is one of an electromagnet and a permanent magnet.

9. The drilling and bolting device of claim 1, wherein the magnet is a first magnet, wherein the block further includes a second magnet extending at least partially along a perimeter of the first magnet.

10. A drilling and bolting device comprising:

a frame;

a drive unit supported for movement relative to the frame, the drive unit including a block, a motor supported on the block, and a chuck for receiving a drill element, the chuck driven by the motor, wherein the motor is a switched reluctance motor positioned at least partially within the block; and an actuator for moving the drive unit relative to the frame, the actuator including a magnet exerting a magnetic force on the block to provide magnetic coupling between the actuator and the block.

11. The drilling and bolting device of claim 10, wherein the frame is a feed frame supported for movement along an extendable base frame.

12. The drilling and bolting device of claim 10, wherein the frame is a base frame, the drilling and bolting device further comprising a feed frame supported for movement relative to the base frame along a feed axis, wherein operation of the actuator moves the feed frame relative to the base frame, wherein the drive unit is directly supported on the feed frame.

13. The drilling and bolting device of claim 10, wherein the actuator further includes an elongated threaded shaft and the magnet is threadably coupled to the threaded shaft, the threaded shaft oriented parallel to a feed axis, rotation of the threaded shaft causing the magnet to move along the threaded shaft, the movement of the magnet causing corresponding movement of the block parallel to the feed axis.

14. The drilling and bolting device of claim 13, wherein the threaded shaft is driven by an electric motor.

15. The drilling and bolting device of claim 13, wherein the magnet is eccentrically mounted with respect to the threaded shaft, a center of the magnet being offset from the threaded shaft.

16. The drilling and bolting device of claim 10, wherein the magnet is movable in a direction parallel to a feed axis, the magnet having a non-circular cross-section.

17. The drilling and bolting device of claim 10, wherein the magnet is one of an electromagnet and a permanent magnet.

18. The drilling and bolting device of claim 10, wherein the magnet is a first magnet, wherein the block further includes a second magnet extending at least partially along a perimeter of the first magnet.

* * * * *